US005290675A

United States Patent [19]

Hioki et al.

[11] Patent Number: 5,290,675

[45] Date of Patent: Mar. 1, 1994

[54] SILVER HALIDE PHOTOGRAPHIC MATERIAL

[75] Inventors: Takanori Hioki; Takashi Kato; Tadashi Ikeda; Naoto Ohshima, all of Kanagawa, Japan

[73] Assignee: Fuji Photo Film Co., Ltd., Kanagawa, Japan

[21] Appl. No.: 772,746

[22] Filed: Oct. 7, 1991

[30] Foreign Application Priority Data

Oct. 8, 1990 [JP] Japan ..... 2-270161

[51] Int. Cl.[5] ..... G03C 1/20; G03C 1/28

[52] U.S. Cl. ..... 430/576; 430/584

[58] Field of Search ..... 430/576, 584

[56] References Cited

U.S. PATENT DOCUMENTS

| | | | |
|---|---|---|---|
| 2,481,022 | 8/1949 | Kendall et al. | 430/594 |
| 5,037,733 | 8/1991 | Goda | 430/584 |
| 5,093,226 | 3/1992 | Ohshima | 430/584 |

FOREIGN PATENT DOCUMENTS

| | | | |
|---|---|---|---|
| 297804 | 1/1989 | European Pat. Off. | 430/576 |

OTHER PUBLICATIONS

Luo et al., "Studies of Supersensitization of Some Bridged Dicarbocyanines by Triazino Stibenedisolfonic Acids", Journal of Imaging Science, 32(2), 1988, pp. 81-84.

*Primary Examiner*—Janet C. Baxter
*Attorney, Agent, or Firm*—Sughrue, Mion, Zinn, Macpeak & Seas

[57] ABSTRACT

A silver halide photographic material comprising on a support at least one silver halide emulsion layer having a silver halide content of not lower than 90 mol %, wherein a silver halide emulsion in at least one of said silver halide emulsion layers having a silver chloride content of not lower than 90 mol % contains at least one compound represented by formula (I):

(I)

wherein $Z_1$ and $Z_2$ each represents an atomic group required for forming a nitrogen-containing five-membered or six-membered heterocyclic ring; $Q_1$ and $Q_2$ each represents a methylene group; $R_1$ and $R_2$ each represents an alkyl group; $R_3$ represents an alkyl group, an aryl group or a heterocyclic group; $L_1$, $L_2$, $L_3$, $L_4$ and $L_5$ each represents a methine group; $n_1$ and $n_2$ each represents 0 or 1; $M_1$ represents a counter ion for neutralizing electric charge; and $m_1$ represents a number not less than 0 required for neutralizing electric charge in the molecule.

15 Claims, No Drawings

SILVER HALIDE PHOTOGRAPHIC MATERIAL

FIELD OF THE INVENTION

The present invention relates to a silver halide photographic material, and more particularly to a silver halide photographic material containing a silver halide emulsion having a silver chloride content of not lower than 90 mol %.

BACKGROUND OF THE INVENTION

Silver chlorobromide containing substantially no silver iodide is used for expediting the development speed of products used in the market where there is a great demand to finish a large amount of prints in a very short period of time as in photographic materials for color photographic paper.

The demand for improving rapid processing of color photographic paper has increased more and more in recent years, and there have been made many studies directed to the improvement thereof. For example, it is well known that when the silver chloride content of silver halide emulsions used is increased, the development speed can be greatly improved.

Further, it is conventionally well known that sensitizing dyes are added to silver halide emulsions to enlarge the sensitive wavelength regions of the silver halide emulsions and to optically sensitize the emulsions in the preparation of silver halide photographic materials.

Many compounds, conventionally referred to as spectral sensitizing dyes, are used for this purpose. Examples of spectral sensitizing dyes conventionally used include cyanine dyes, merocyanine dyes and xanthene dyes described in T. H. James, *The Theory of the Photographic Process,* third edition, pp. 198 to 228 (Macmillan, N. Y., 1966). It is also known that these dyes may be used either alone or in combination (e.g., for the purpose of supersensitization).

Generally, when these sensitizing dyes are applied to silver halide emulsions, only the sensitive wavelength regions of the silver halide emulsions are enlarged, but the following conditions must also be met.

(1) The material is spectrally sensitized to the proper region.

(2) Sensitizing efficiency is good, and sufficiently high sensitivity can be obtained.

(3) Fogging is not caused.

(4) The difference in photographic performance caused by the difference between lots (i.e., variability from lot to lot) in the preparation of silver halide photographic emulsions is small.

(5) Unevenness in sensitivity due to change in temperature during exposure is small.

(6) There is no adverse interaction of the dyes with other additives such as stabilizers, anti-fogging agents, coating aids, color formers, etc.

(7) A lowering in sensitivity is not caused when silver halide emulsions containing sensitizing dyes are stored, particularly under high temperature and humidity conditions.

(8) Color turbidity (color stain) is not caused by diffusing the added sensitizing dyes in other light-sensitive layers after development.

The above-described conditions are important factors in the preparation of silver halide emulsions, particularly for silver halide color photographic materials.

Supersensitization is described in *Photographic Science and Engineering,* Vol. 13, pp. 13 to 17 (1969), ibid., Vol. 18, pp. 418 to 430 (1974) and James, *The Theory of the Photographic Process,* 4th Edition, p. 259 (Macmillan, 1977). It is known that high sensitivity can be obtained by choosing suitable sensitizing dyes and supersensitizing agents.

However, when using silver halide emulsions having a high silver chloride content (namely, high silver chloride emulsion) which have increasingly been in demand lately in the photographic market as described above, there is much difficulty in obtaining sensitizing dyes which satisfactorily meet the above-described requirements which can be fulfilled by emulsions mainly composed of silver bromide.

Thus the difficulty in obtaining high silver chloride emulsions which have high sensitivity and sufficiently high storage stability and are low in variability from lot to lot is a very important problem to be solved.

Attempts have been conventionally made (1) to improve the spectral sensitivity or preservability with time of silver halide emulsions containing silver chloride which is spectrally sensitized with spectral sensitizing dyes or (2) to prevent the emulsions from being fogged by infrared rays. For example, JP-B-4610473 (the term "JP-B" as used herein means an "examined Japanese Patent publication") and JP-B-48-42494 propose the addition of nitrogen-containing compounds, JP-A-505035 (the term "JP-A" as used herein means an "unexamined published Japanese patent application") proposes the addition of supersensitizing agents, JP-A-52-151026 proposes the addition of water-soluble bromides, JP-A-54-23520 proposes the addition of iridium and JP-A-60-202436 proposes the addition of hardening agents. Further, JP-A-58-7629 discloses an improved method for adding spectral sensitizing dyes, and JP-A-60-225147 proposes the use of silver chlorobromide having (100) face and (111) face.

It is conventionally known that pentamethinecyanine compounds in which the 2- and 4-positions o the methine chain are crosslinked with a trimethylene group, are superior in sensitivity and storage stability. For example, these compounds are described in JP-A-60202436, JP-A-60-220339, JP-A-60-225147, JP-A-61-123834, JP-A-62-87953, JP-A-63-264743, JP-A-1-155334, JP-A-1177533, JP-A-1-198743, JP-A-1-216342, JP-A-2-42, JP-B-60-57583 and U.S. Pat. No. 4,618,570.

However, these patent specifications disclose only dyes in which the 2- and 4-positions on the methine chain are crosslinked with 2,2'-dimethyltrimethylene group as in the following dye A.

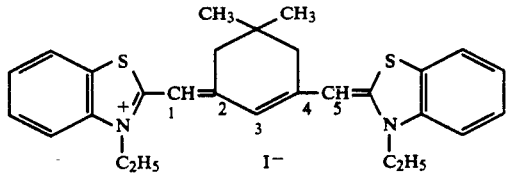

(A)

Further, dyes in which the 2- and 4-positions on the methine chain are crosslinked with an unsubstituted trimethylene group, are disclosed in U.S. Pat. No. 2,481,022.

Furthermore, dyes in which a trimethylene crosslinking group substituted by an alkyl or aryl group on the 2-position is positioned at the 2- and 4-positions on the methine chain, are disclosed in U.K. Patents 595,783, 595,784, 595,785 and 604 2,481,022 and 2,756,227,

*Kanko Kagaku Yoko Kagaku,* page 39 (1987) (written in Japanese), and *Journal of Imaging Science,* 32, page 81 (1988).

With regard to photographic performance as silver halide photographic material, however, the above references have only limited disclosures. Thus, U.S. Pat. No. 2,481,022 discloses that silver iodobromide is spectral-sensitized; *Journal of Imaging Science,* 32, page 81 (1988) discloses that silver bromide is spectral-sensitized; and *Kanko Kagaku Yoko Kagaku,* page 39 (1987) discloses that silver chlorobromide is spectral-sensitized.

SUMMARY OF THE INVENTION

Accordingly, an object of the present invention is to provide a silver halide emulsion which has high sensitivity and scarcely causes a change in sensitivity during storage under high temperature and/or high humidity conditions; that is, excellent in storage stability with time.

Another object of the present invention is to provide a silver halide photographic material containing silver halide emulsions having very little variability in sensitivity from production lot to production lot.

The above-described objects of the present invention have been achieved by providing a silver halide photographic material comprising on a support at least one silver halide emulsion layer having a silver chloride content of not lower than 90 mol %, wherein a silver halide emulsion in at least one of said silver halide emulsion layers having a silver chloride content of not lower than 90 mol % contains at least one compound represented by formula (I):

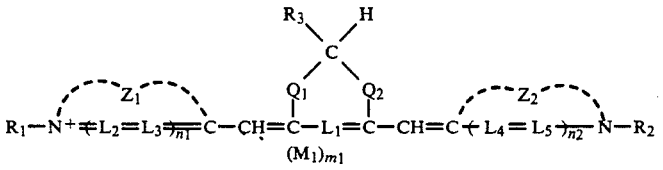

(I)

wherein $Z_1$ and $Z_2$ each represents an atomic group required for forming a nitrogen-containing five-membered or six-membered heterocyclic ring; $Q_1$ and $Q_2$ each represents a methylene group; $R_1$ and $R_2$ each represents an alkyl group; $R_3$ represents an alkyl group, an aryl group or a heterocyclic group; $L_1$, $L_2$, $L_3$, $L_4$ and $L_5$ each represents a methine group; $n_1$ and $n_2$ each represents 0 or 1; $M_1$ represents a counter ion for neutralizing electric charge; and $m_1$ represents a number not less than 0 required for neutralizing electric charge in the molecule.

The prior art literature described in the Background of the Invention does no disclose that compounds having a specific structural crosslinking group on the methine chain, represented by formula (I) of the present invention are superior in photographic performance in silver halide emulsions to compounds such as dye A wherein the 2- and 4-positions are crosslinked with 2,2'-dimethyltrimethylene group and are superior to the dyes wherein the 2- and 4-positions are crosslinked with an unsubstituted trimethylene group. Further, the above-described literature discloses nothing about photographic performance of these compounds in high silver chloride emulsions.

DETAILED DESCRIPTION OF THE INVENTION

The compounds of formula (I) are illustrated in more detail below.

Examples of the nucleus formed by $Z_1$ and $Z_2$ include a thiazole ring nucleus [e.g., a thiazole nucleus (e.g., thiazole, 4-methylthiazole, 4-phenylthiazole, 4,5-dimethylthiazole, 4,5-diphenylthiazole), a benzthiazole nucleus (e.g., benzthiazole, 4-chlorobenzthiazole, 5-chlorobenzthiazole, 6-chlorobenzthiazole, 5-nitrobenzthiazole, 4-methylbenzthiazole, 5-methylbenzthiazole, 6-methylbenzthiazole, 5-bromobenzthiazole, 6-bromobenzthiazole, 5-iodobenzthiazole, 5-phenylbenzthiazole, 5-methoxybenzthiazole, 6-methoxybenzthiazole, 5-ethoxybenzthiazole, 5-ethoxycarbonylbenzthiazole, 5-carboxybenzthiazole, 5-phenethylbenzthiazole, 5-fluorobenzthiazole, 5-chloro-6-methylbenzthiazole, 5,6-dimethylbenzthiazole, 5,6-dimethoxybenzthiazole, 5-hydroxy-6-methylbenzthiazole, tetrahydrobenzthiazole, 4-phenylbenzthiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)], a thiazoline nucleus (e.g., thiazoline, 4-methylthiazoline, 4-nitrothiazoline), an oxazole ring nucleus [e.g., an oxazole nucleus (e.g., oxazole, 4-methyloxazole, 4-nitrooxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), a naphthoxazole nucleus (e.g., naphtho[2,1-d]oxazole, naphtho[1,2-d]oxazole, naphtho [2,3-d]oxazole, 5-nitronaphtho[2,1-d]oxazole)], an oxazoline nucleus (e.g., 4,4-dimethyloxazoline), a selenazole ring nucleus [e.g., a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]selenazole)], a selenazoline nucleus (e.g., selenazoline, 4-methylselenazoline), a tellurazole ring nucleus [e.g., a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)], a tellurazoline nucleus (e.g., tellurazoline, 4-methyltellurazoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), an imidazole ring nucleus [e.g., an imidazole nucleus (e.g., 1-alkylimidazole, 1-alkyl-4-phenylimidazole, 1-arylimidazole), alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-flurobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthoimidazole nucleus (e.g., 1-alkylnaphtho[1,2-d]imidazole, 1-arylnaphtho[1,2-d]imidazole) (the above-mentioned alkyl groups for the imidazole nuclei have 1 to 8 carbon atoms, preferred examples of the alkyl group include an unsubstituted alkyl group such as methyl, ethyl, propyl, isopropyl and butyl and a hydroxyalkyl group such as 2-hydroxyethyl and 3-hydroxypropyl with methyl and ethyl being particularly preferred; the above-mentioned aryl groups for the imidazole nuclei include phenyl, a halogen (e.g., a chlorine)-substituted phenyl group, an alkyl (e.g., a methyl)-substituted phenyl group and an alkoxy (e.g., a methoxy)-substituted phenyl group)], a pyridine nucleus (e.g., 2-pyridine, 4-pyridine, 5-methyl-2-pyridine, 3-methyl-4-pyridine), a quinoline ring nucleus [e.g., a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy 4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), an isoquinoline nucleus (e.g., 6-nitro-1-isoquinoline, 3,4-dihydro 1-isoquinoline, 6-nitro-3-isoquinoline)], an imidazo[4,5-b]quinoxaline nucleus (e.g., 1,3-diethylimidazo[4,5-b]quinoxaline, 6-chloro-1,3-diallylimidazo[4,5-b]quinoxaline), an oxadiazole nucleus, a thiadiazole nucleus, a tetrazole nucleus and a pyrimidine nucleus.

Preferred nuclei formed by $Z_1$ and $Z_2$ 2 are a benzthiazole nucleus, a naphthothiazole nucleus, a benzoxazole nucleus and a naphthoxazole nucleus.

$Q_1$ and $Q_2$ each represents an unsubstituted methylene group or a substituted methylene group (e.g., a methylene group substituted by one or more of a carboxyl group, a sulfo group, a cyano group, a halogen atom (e.g., fluorine, chlorine, bromine), a hydroxyl group, an alkoxycarbonyl group having not mor than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 15 carbon atoms (e.g., phenoxy, p-tolyloxy), an acyloxy group having not more than 8 carbon atoms (e.g., acetyloxy, propionyloxy), an acyl group having not more than 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group (e.g., phenyl, 4-chlorophenyl, 4-methylphenyl, α-naphthyl)).

Preferably, $Q_1$ and $Q_2$ are each an unsubstituted methylene group.

The alkyl group represented by $R_1$ and $R_2$ is preferably an unsubstituted alkyl group having not more than 18 carbon atoms (e.g., methyl, ethyl, propyl, butyl, pentyl, hexyl, heptyl, octyl, decyl, dodecyl, octadecyl) or a substituted alkyl group (e.g., an alkyl group having not more than 18 carbon atoms which is substituted by one or more of a carboxyl group, a sulfo group, a cyano group, a halogen atom (e.g., fluorine, chlorine, bromine), a hydroxyl group, an alkoxycarbonyl group having not more than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 15 carbon atoms (e.g., phenoxy, p-tolyloxy), an acyloxy group having not more than 8 carbon atoms (e.g., acetyloxy, propionyloxy), an acyl group having not more than 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group having not more than 15 carbon naphthyl)).

More preferably, $R_1$ and $R_2$ are each an unsubstituted alkyl group (e.g., methyl, ethyl, propyl, butyl, pentyl, hexyl, heptyl, octyl) or a sulfoalkyl group (e.g., 2-sulfoethyl, 3-sulfopropyl, 4-sulfobutyl).

$R_3$ is preferably an alkyl group having 1 to 18 carbon atoms, preferably 1 to 7 carbon atoms, particularly preferably 1 to 4 carbon atoms (e.g., methyl, ethyl, propyl, isopropyl, butyl, isobutyl, hexyl, octyl, dodecyl, octadecyl), a substituted alkyl group [e.g., an aralkyl group (e.g., benzyl, 2-phenylethyl), a hydroxy alkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (e.g., 3-sulfatopropyl, 4-sulfatobutyl), a heterocyclic-substituted alkyl group (e.g., 2-(pyrrolidine-2-one-1-yl)ethyl, tetrahydrofurfuryl, 2-morpholinoethyl), 2-acetoxyethyl group, carboxymethyl group, 2-methanesulfonylaminoethyl group], allyl group, an aryl group (e.g., phenyl, 2-naphthyl, 1-naphthyl), a substituted aryl group (e.g., 4-carboxyphenyl, 4-sulfophenyl, 3-chlorophenyl, 3-methylphenyl), a heterocyclic group (e.g., 2-pyridyl, 2-thiazolyl, 2-furyl, 2-thiophenyl) or a substituted heterocyclic group (e.g., 4-methyl-2-pyridyl, 4-phenyl-2-thiazolyl).

More preferably, $R_3$ is a substituted or unsubstituted aryl group with phenyl being particularly preferred.

$L_1$, $L_2$, $L_3$, $L_4$ and $L_5$ each is a methine group or a substituted methine group [e.g., a methine group substituted by one or more of a substituted o unsubstituted alkyl group (e.g., methyl, ethyl, 2-carboxyethyl), a substituted or unsubstituted aryl group (e.g., phenyl, o-carboxyphenyl), a halogen atom (e.g., chlorine, bromine), an alkoxy group (e.g., methoxy, ethoxy) and an amino group (e.g., N,N-diphenylamino, N-methyl-N-phenylamino, N-methylpiperazino)], or any $L_1$ to $L_5$ methine group may be combined together with other methine groups to form a ring.

Preferably, $L_1$, $L_2$, $L_3$, $L_4$ and $L_5$ each is an unsubstituted methine group.

$n_1$ and $n_2$ each is 0 or 1. Preferably, $n_1$ and $n_2$ each is 0.

$M_1$ and $m_1$ are included within the formula to show the presence or absence of a cation or anion when such ions are necessary to neutralize the electric charge of the dye. Whether a dye is a cation or anion or has a net ionic charge depends on auxochrome and substituent groups.

Typical cations are an ammonium ion and an alkali metal ions. The anion may be an inorganic anion or an organic anion. Examples of the anion include halide anions (e.g., fluoride, chloride, bromide, iodide), substituted arylsulfonate ions (e.g., p-toluenesulfonate, p-chlorobenzenesulfonate), aryldisulfonate ions (e.g., 1,3-benzenedisulfonate, 1,5-naphthalenedisulfonate, 2,6-naphthalenedisulfonate), alkylsulfate ions (e.g., methylsulfate), sulfate ions, thiocyanate ions, perchlorate ions, tetrafluoroborate ions, picrate ions, acetate ions and trifluoromethanesulfonate ions.

Of these, a perchlorate ion, an iodide ion and a substituted arylsulfonate ion (e.g., p-toluenesulfonate) are preferred.

Specific examples of dyes represented by formula (I) of the present invention include, but are not limited to, the following compounds.

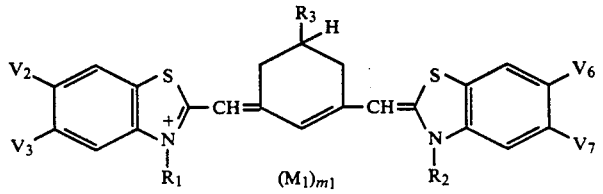

| Compound No. | $R_1$ | $R_2$ | $R_3$ | $V_2$ | $V_3$ | $V_6$ | $V_7$ | $M_1$ | $m_1$ |
|---|---|---|---|---|---|---|---|---|---|
| 1 | $C_2H_5$ | $C_2H_5$ | $CH_3$ | $CH_3$ | H | $CH_3$ | H | $I^-$ | 1 |
| 2 | $(n)C_5H_{11}$ | $C_2H_{11}$ | $CH_3$ | $CH_3$ | H | $CH_3$ | H | $I^-$ | 1 |
| 3 | $C_2H_5$ | $C_2H_5$ | 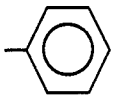 | $CH_3$ | H | $CH_3$ | H | $I^-$ | 1 |
| 4 | $(n)C_5H_{11}$ | $C_2H_5$ | 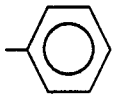 | $CH_3$ | H | $CH_3$ | H | $I^-$ | 1 |
| 5 | $C_2H_5$ | $C_2H_5$ | $C_2H_5$ | H | H | H | H | 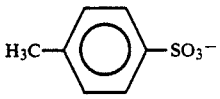 | 1 |
| 6 | $C_2H_5$ | $C_2H_5$ | $CH_3$ | H | Cl | H | Cl | $Br^-$ | 1 |
| 7 | $C_2H_5$ | $C_2H_5$ | $(n)C_3H_7$ | $OCH_3$ | H | $OCH_3$ | H | $ClO_4^-$ | 1 |
| 8 | $C_2H_5$ | $C_2H_5$ | $CH_3$ | H | $CH_3$ | H | H | 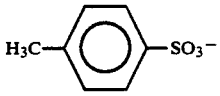 | 1 |
| 9 | $(CH_2)_4SO_3^-$ | $CH_3$ | $CH_3$ | H | H | H | H | — | — |
| 10 | $(CH_2)_3SO_3^-$ | $(CH_2)_3SO_3^-$ | $CH_3$ | H | H | H | H | $HN^+(C_2H_5)_3$ | 1 |
| 11 | $C_2H_5$ | $(n)C_3H_7$ | 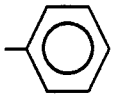 | $CH_3$ | $CH_3$ | $OCH_3$ | H | $Br^-$ | 1 |
| 12 | $C_2H_5$ | $C_2H_5$ | $CH_3$ | H | $O(n)C_3H_7$ | H | $O(n)C_3H_7$ | $ClO_4^-$ | 1 |
| 13 | $C_2H_5$ | $C_2H_5$ | 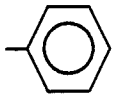 | H | Cl | H | Cl | $ClO_4^-$ | 1 |

-continued

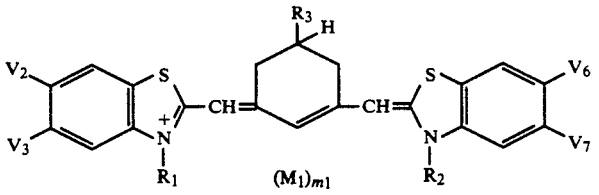

| Compound No. | $R_1$ | $R_2$ | $R_3$ | $V_2$ | $V_3$ | $V_6$ | $V_7$ | $M_1$ | $m_1$ |
|---|---|---|---|---|---|---|---|---|---|
| 14 | $C_2H_5$ | $C_2H_5$ | 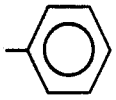 | H | $CH_3$ | H | $CH_3$ | $I^-$ | 1 |
| 15 | $C_2H_5$ | $C_2H_5$ | 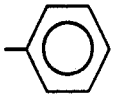 | H | $OCH_3$ | H | $OCH_3$ | $Cl^-$ | 1 |
| 16 | $C_2H_5$ | $C_2H_5$ | 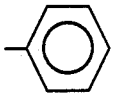 | $OCH_3$ | H | $OCH_3$ | H | $Br^-$ | 1 |
| 17 | $C_2H_5$ | $C_2H_5$ | 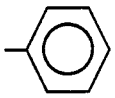 | H | $OCH_3$ | H | Cl | $ClO_4^-$ | 1 |
| 18 | $(CH_2)_3SO_3^-$ | $CH_3$ | 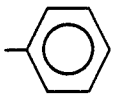 | H | H | H | H | — | — |
| 19 | $(CH_2)_2OH$ | $(CH_2)_2OH$ | 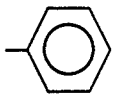 | H | H | H | H | $ClO_4^-$ | 1 |
| 20 | $(CH_2)_3SO_3^-$ | $(CH_2)_3SO_3^-$ | 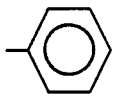 | H | H | H | H | $Na^+$ | 1 |
| 21 | $C_2H_5$ | $C_2H_5$ | $CH_3$ | H | H | $OCH_3$ | $OCH_3$ | $Cl^-$ | 1 |
| 22 | $C_2H_5$ | $C_2H_5$ | $CH_3$ | $-OCH_2O-$ | | $-OCH_2O-$ | | $I^-$ | 1 |
| 23 | $C_2H_5$ | $C_2H_5$ | 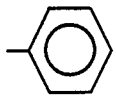 | $OCH_3$ | $OCH_3$ | $OCH_3$ | $OCH_3$ | $ClO_4^-$ | 1 |
| 24 | $C_2H_5$ | $C_2H_5$ | 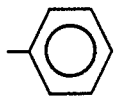 | $-OCH_2O-$ | | $-OCH_2O-$ | | $I^-$ | 1 |

(25)

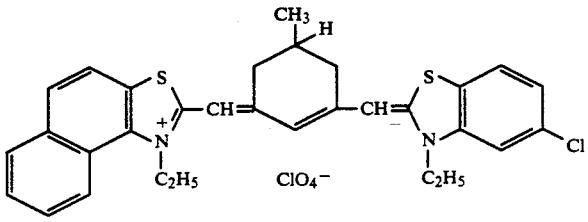

-continued
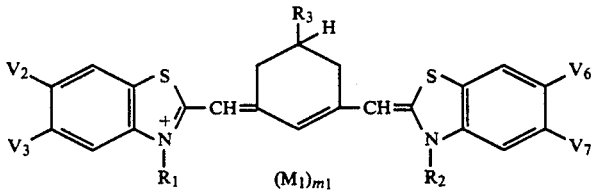
| Compound No. | $R_1$ | $R_2$ | $R_3$ | $V_2$ | $V_3$ | $V_6$ | $V_7$ | $M_1$ | $m_1$ |
|---|---|---|---|---|---|---|---|---|---|
| (26) | | | | | | | | | |
| (27) | | | | | | | | | |
| (28) | | | | | | | | | |
| (29) | | | | | | | | | |
| (30) | | | | | | | | | |
| (31) | | | | | | | | | |
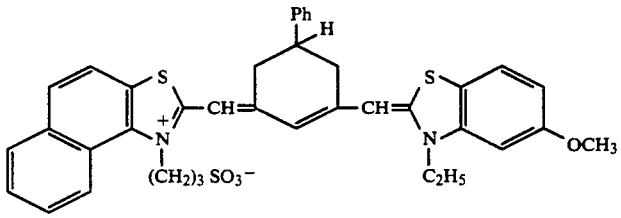
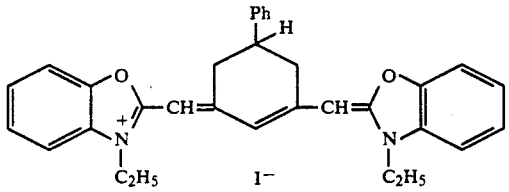
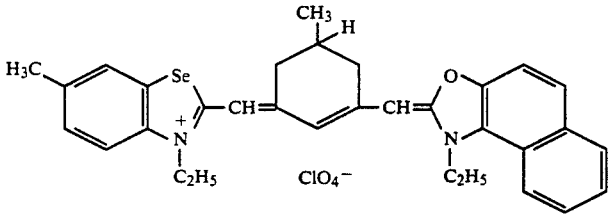
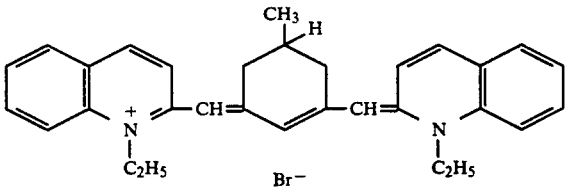
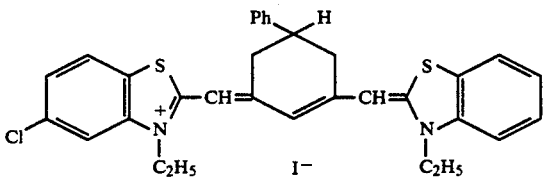
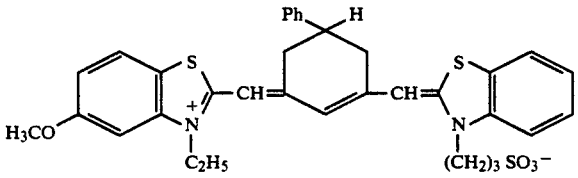

-continued

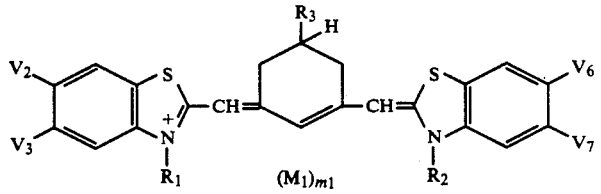

| Compound No. | $R_1$ | $R_2$ | $R_3$ | $V_2$ | $V_3$ | $V_6$ | $V_7$ | $M_1$ | $m_1$ |
|---|---|---|---|---|---|---|---|---|---|
| (32) | | | | | | | | | |
| (33) | | | | | | | | | |

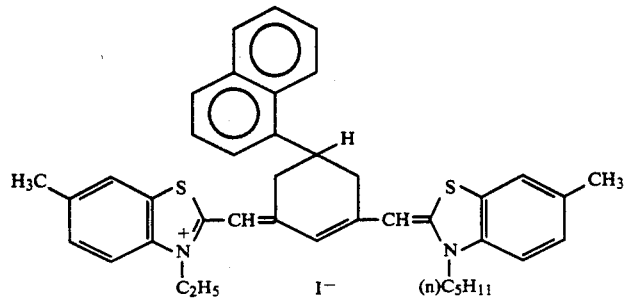

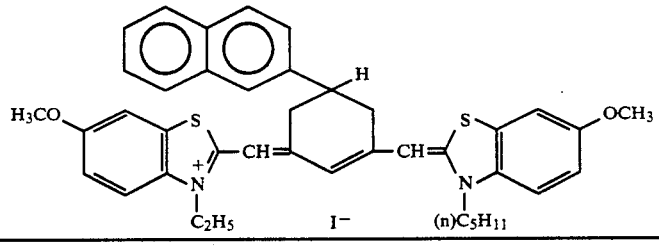

The compounds of formula (I) according to the present invention can be synthesized according to the methods described in F. M. Hamer, *Heterocyclic Compounds-Cyanine Dyes and Related Compounds* (John Wiley & Sons New York, London, 1964) and D. M. Sturmer, *Heterocyclic Compounds-Special Topics in Heterocyclic Chemistry,* Chapter 8, Paragraph 4, pp. 482 to 515 (John Wiley & Sons, New York, London, 1977).

In the present invention, the sensitizing dyes of formula (I) are present in an amount of $5\times10^{-7}$ to $5\times10^{-3}$ mol, preferably $1\times10^{-6}$ to $1\times10^{-3}$ mol, particularly preferably $2\times10^{-6}$ to $5\times10^{-4}$ mol per mol of silver halide in the silver halide photographic emulsion layers in which they are present.

The sensitizing dyes used in the present invention can be directly dispersed in the emulsions, or the dyes can be added in the form of a solution to the emulsions by dissolving them in an appropriate solvent such as methyl alcohol, ethyl alcohol, methyl cellosolve, acetone, water, pyridine or a mixed solution thereof. If desired, dissolution can be effected by an ultrasonic wave.

Examples of methods for adding the sensitizing dyes include a method in which the dye is dissolved in a volatile organic solvent, the resulting solution is dispersed in hydrophilic colloid and the resulting dispersion is added to the emulsion as described in U.S. Pat. No. 3,469,987; a method in which a water-insoluble dye is dispersed in a water-soluble solvent without dissolving the dye, and the dispersion is added to the emulsion as described in JP-B-46-24185; a method in which the dye is dissolved in a surfactant, and the resulting solution is added to the emulsion as described in U.S. Pat. No. 3,822,135; a method in which the dye is dissolved in a compound which causes the dye to be red-shifted, and the resulting solution is added to the emulsion as described in JP-A-51-74624; and a method in which the dye is dissolved in an acid containing substantially no water, and the resulting solution is added to the emulsion as described in JP-A-50-80826. Further, the dyes can be added to the emulsions according to the methods described in U.S. Pat. Nos. 2,912,343, 3,342,605, 2,996,287 and 3,429,835.

The sensitizing dyes may be uniformly dispersed in the silver halide emulsions before the emulsions are coated on a support. It is preferable that the addition of the dyes is effected before chemical sensitization or in the latter half of the formation of silver halide grains.

Supersensitization carried out by compounds represented by the following formulas (II) and (III) are particularly useful in the spectral sensitization of the present invention.

When the supersensitizing agents represented by formula (II) are used in combination with the supersensitizing agents represented by formula (III), the supersensitizing effect can be peculiarly increased.

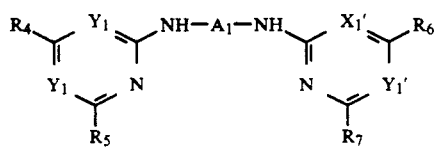

(II)

wherein $A_1$ represents a divalent aromatic group; $R_4$, $R_5$, $R_6$ and $R_7$ each represents a hydrogen atom, a hydroxyl group, an alkyl group, an alkoxy group, an aryloxy group, a halogen atom, a heterocyclic ring group, a heterocyclic thio group, an arylthio group, an amino group, an alkylamino group, an arylamino group, an aralkylamino group, an aryl group or a mercapto group. These groups may be substituted.

At least one of $A_1$, $R_4$, $R_5$, $R_6$ and $R_7$ must be a group having a sulfo group. $X_1$, $Y_1$, $X_1'$, and $Y_1'$ each represents —CH= or —N=, and at least one of $X_1$ and $Y_1$ and at least one of $X_1'$ and $Y_1'$ represent —N=.

The compounds of formula (II) are illustrated in more detail below.

In formula (II), $—A_1—$ represents a divalent aromatic group which may have an $—SO_3M$ group, wherein M is a hydrogen atom or a cation (e.g., sodium, potassium) for making the compound water-soluble.

A group selected from the following $—A_2—$ and $—A_3—$ is useful as $—A_1—$. However, when $R_4$, $R_5$, $R_6$ or $R_7$ does not have an $—SO_3M$ group, $—A_1—$ is selected from the following $—A_3—$ groups.

(A2-1)

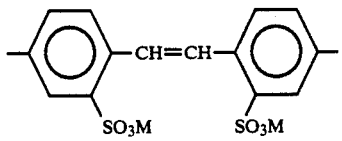

(A2-2)

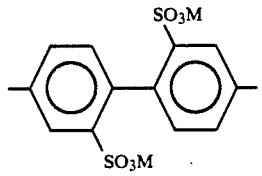

(A2-3)

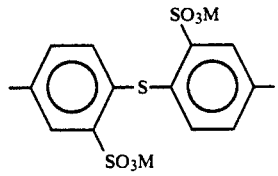

(A2-4)

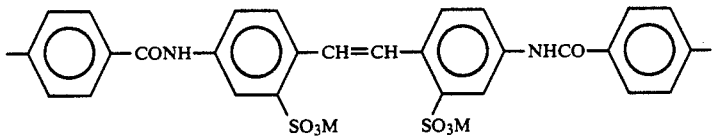

(A2-5)

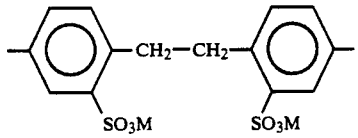

(A2-6)

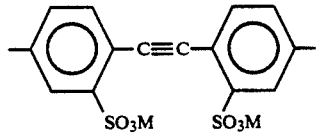

(A2-7)

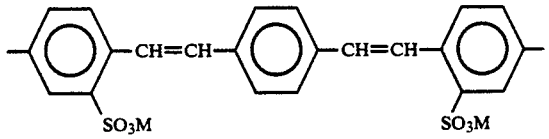

(A2-8)

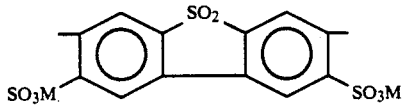

-continued

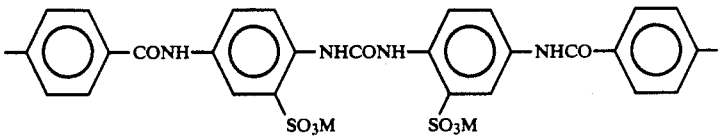

(A2-9)

and the like. M is a hydrogen atom or a cation for making the compound water-soluble.

—A3—:

(A3-1)

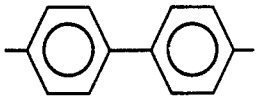

(A3-2)

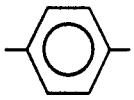

(A3-3)

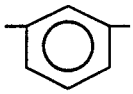

(A3-4)

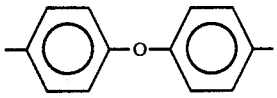

(A3-5)

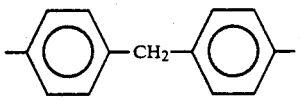

(A3-6)

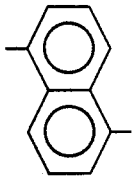

(A3-7)

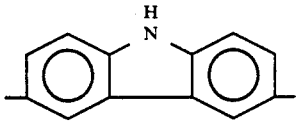

and the like.

$R_4$, $R_5$, $R_6$ and $R_7$ each represents a hydrogen atom, a hydroxyl group, an alkyl group (having preferably 1 to 8 carbon atoms e.g., methyl, ethyl, n-propyl, n-butyl), an alkoxy group (having preferably 1 to 8 carbon atoms, e.g., methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic nucleus (e.g., morpholinyl, piperidyl), an alkylthio group (e.g., methylthio, ethylthio), a heterocyclic thio group (e.g., benzthiazolylthio, benzimidazolylthio, phenyltetrazolylthio), an arylthio group (e.g., phenylthio, tolylthio), an amino group, an unsubstituted or substituted alkylamino group (e.g., methylamino, ethylamino, propylamino, dimethylamino, diethylamino, dodecylamino, cyclohexylamino, β-hydroxyethylamino, di(β-hydroxyethyl)amino, β-sulfoethylamino), an unsubstituted or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g., 2-benzthiazolylamino, 2-pyridylamino), a substituted or unsubstituted aralkylamino group (e.g., benzylamino, o-anisylamino, m-anisylamino, p-anisylamino), an aryl group (e.g., phenyl) or a mercapto group.

$R_4$, $R_5$, $R_6$ and $R_7$ may be the same or different. When —$A_1$— is a member selected from the group consisting of —$A_1$—, at least one of $R_4$, $R_5$, $R_6$ and $R_7$ must be a group having a sulfo group (in free form or in the form of a salt). $X_1$, $Y_1$, $X_1'$ and $Y_1'$ each represents —CH= or —N=, and the case where $X_1$ and $X_1'$ are —CH= and $Y_1$ and $Y_1'$ are —N= is preferable.

Specific examples of the compounds of formula (II) which can be used in the present invention include, but are not limited to the following compounds.

(II-1) Disodium salt of 4,4'-bis[2,6-di-(2-naphthoxy)-pyrimidine-4-ylamino]stilbene-2,2'-disulfonic acid (II-2) Disodium salt of 4,4'-bis[2,6-di-(2-naphthylamino)pyrimidine-4-ylamino]stilbene-2,2'-disulfonic acid (II-3) Disodium salt of 4,4'-bis(2,6-dianilinopyrimidine-4-ylamino)stilbene-2,2'-disulfonic acid (II-4) Disodium salt of 4,4'-bis[2-(2-naphthylamino)-6-anilinopyrimidine-4-ylamino]stilbene-2,2'-disulfonic acid (II-5) Ditriethylammonium salt of 4,4'-bis-[2,6-diphenoxypyrimidine-4-ylamino]stilbene-2,2'-disulfonic acid (II-6) Disodium salt of 4,4'-bis[2,6-di-(benzimidazolyl-2-thio)pyrimidine-4-ylamino]stilbene-2,2'-disulfonic acid (II-7) Disodium salt of 4,4'-bis[4,6-di-(benzthiazolyl-2-thio)pyrimidine-2-ylamino]stilbene-2,2'-disulfonic acid (II-8) Disodium salt of 4,4'-bis[4,6-di-(benzthiazolyl-2-amino)pyrimidine-2-ylamino]stilbene-2,2'-disulfonic acid (II-9) Disodium salt of 4,4'-bis[4,6-di-(naphthyl-2-oxy)-pyrimidine-2-ylamino]stilbene-2,2'-disulfonic acid (II-10) Disodium salt of 4,4'-bis(4,6-diphenoxypyrimidine-2-ylamino]stilbene-2,2'-disulfonic acid (II-11) Disodium salt of 4,4'-bis(4,6-di-phenylthiopyrimidine-2-ylamino)stilbene-2,2'-disulfonic acid (II-12) Disodium salt of 4,4'-bis[4,6-di-mercaptopyrimidine-2-ylamino)biphenyl-2,2'-disulfonic acid (II-13) Disodium salt of 4,4'-bis(4,6-dianilinotriazine-2-ylamino)stilbene-2,2'-disulfonic acid (II-14) Disodium salt of 4,4'-bis(4-anilino-6-hydroxytriazine-2-ylamino)stilbene-2,2'-disulfonic acid (II-15) Disodium salt of 4,4'-bis[4,6-di-(naphthyl-2-oxy)-pyrimidine-2-ylamino]bibenzyl-2,2'-disulfonic acid (II-16) Disodium salt of 4,4'-bis(4,6-di-anilinopyrimidine-2-ylamino)stilbene-2,2'-disulfonic acid (II-17) Disodium salt of 4,4'-bis[4-chloro-6-(2-naphthyloxy)pyrimidine-2-ylamino)biphenyl-2,2'-disulfonic acid (II-18) Disodium salt of 4,4'-bis[4,6-di-(1-phenyl tetrazolyl-5-thio)pyrimidine-2-ylamino]stilbene-2,2'-disulfonic acid (II-19) Disodium salt of 4,4'-bis[4,6-di-(benzimidazolyl-2-thio)pyrimidine-2-ylamino]stilbene-2,2'-disulfonic acid (II-20) Disodium salt of 4,4'-bis(4-naphthylamino-6-anilino-triazine-2-ylamino)stilbene-2,2'-disulfonic acid Of these, (II-1) to (II-6), (II-9), (II-15) and (II-20) are preferred, and (II-1), (II-2), (II-4), (II-5), (II-9), (II-15) and (II-20) are particularly preferred.

The compounds of formula (II) are used in an amount of 0.01 to 5 g per mol of silver halide and in a ratio, by weight, of the compound of formula (II) to the sensitizing dye of formula (I) of from 1/1 to 100/1, preferably from 2/1 to 50/1.

It is preferred that the supersensitizing agents of formula (II) are used together with heterocyclic mercapto compounds in the high silver chloride emulsions of the present invention.

Examples of the heterocyclic mercapto compounds are compounds formed by introducing a mercapto group into a heterocyclic compound having a thiazole ring, an oxazole ring, an oxazine ring, a thiazole ring, a thiazoline ring, selenazole ring, an imidazole ring, an indoline ring, a pyrrolidine ring, a tetrazole ring, a thiadiazole ring, a quinoline ring or an oxadiazole ring. Compounds formed by having a carboxyl group, a sulfo group, a carbamoyl group, a sulfamoyl group or a hydroxyl group introduced into the heterocyclic compound are particularly preferred.

JP-B-43-22883 discloses the us of mercapto heterocyclic compounds as supersensitizing dyes. Of these, mercapto compounds represented by the following formula (III) are particularly preferred.

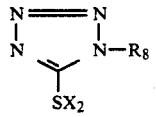
(III)

wherein $R_8$ represents an alkyl group, an alkenyl group or an aryl group and $X_2$ represents a hydrogen atom, an alkali metal atom, an ammonium group or a precursor group. Examples of the alkali metal atom include sodium atom and potassium atom. Examples of the ammonium group include tetramethylammonium and trimethylbenzylammonium. The term "precursor group" as used herein refers to a group which can be converted into H or an alkali metal as $X_2$ under alkaline conditions. Examples of the precursor group include acetyl group, cyanoethyl group and methanesulfonylethyl group.

The alkyl group and the alkenyl group represented by $R_8$ include an unsubstituted group and a substituted group as well as an alicyclic group. Examples of substituent groups for the substituted alkyl group include a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, a carboxyl group (or a salt thereof) and a sulfo group (or a salt thereof).

Each of the above-described ureido, thioureido, sulfamoyl, carbamoyl and amino groups include an unsubstituted group, an N-alkyl-substituted group and an N-aryl-substituted group. Examples of the aryl substituent group include a phenyl group and a substituted phenyl group. Examples of substituent groups for phenyl group include an alkyl group and those already described above in the definition of the substituent groups for the substituted alkyl group.

The mercapto compounds are contained in any layer of the silver halide color photographic material, i.e., in light-sensitive and light-insensitive hydrophilic colloid layers.

The compounds of formula (III) are used in an amount of preferably $1\times10^{-5}$ to $5\times10^{-2}$ mol, more preferably $1\times10^{-4}$ to $1\times10^{-2}$ mol per mol of silver halide when the compounds of formula (III) are contained in the silver halide color photographic materials. The compounds of formula (III) are used in an amount of preferably $1\times10^{-6}$ to $1\times10^{-3}$ mol/l, more preferably $1\times10^{-6}$ to $5\times10^{-4}$ mol/l, when the compounds are added to color developing solutions as anti-fogging agents.

Specific examples of th compounds of formula (III) include, but are not limited to, the following compounds. Examples of the compounds include those described in JP-A-62-269957 (pages 4 to 8). Of these, the following compounds are particularly preferred.

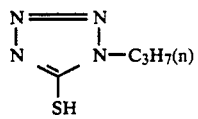
[III-1]

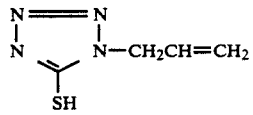
[III-2]

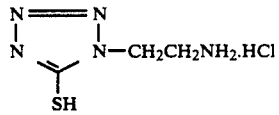
[III-3]

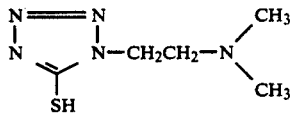
[III-4]

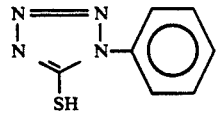
[III-5]

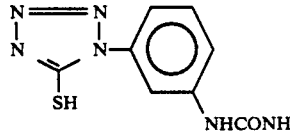
[III-6]

-continued

[III-7]

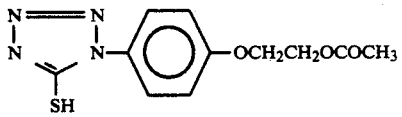

[III-8]

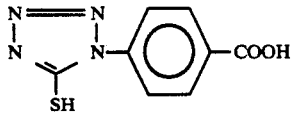

[III-9]

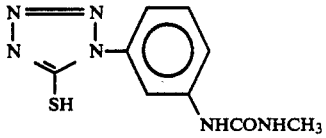

[III-10]

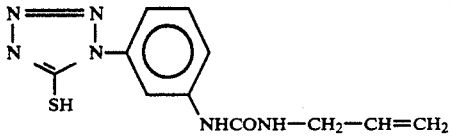

The photographic material of the present invention may comprise on a support at least one blue-sensitive silver halide emulsion layer, at least one green-sensitive silver halide emulsion layer and at least one red-sensitive silver halide emulsion layer. In general-purpose color photographic paper, the emulsion layers are coated on the support in the above order. However, the emulsion layers may be coated in a different order from the above order. An infrared-sensitive silver halide emulsion layer may be used in place of at least one of the above-described emulsion layers.

Color reproduction can be carried out by subtractive color photography by using silver halide emulsions having sensitivity to each wavelength region and dyes having complementary colors to light to be exposed (namely, color couplers which form yellow color to blue light, magenta color to green light and cyan color to red light) in these sensitive emulsion layers. The correlation of the sensitive layers with the color forming hue of the couplers may be different from the above-described correlation.

It is preferred that the silver halide emulsions for use in the present invention comprise silver chloride or silver chlorobromide containing substantially no silver iodide. The term "containing substantially no silver iodide" as used herein refers to a silver iodide content not higher than 1 mol %, preferably not higher than 0.2 mol %.

Silver halide grains in the emulsion may be different in halogen composition from one another, or may have the same halogen composition. However, when an emulsion comprising grains having the same halogen composition is used, the properties of grains can easily be made uniform.

With regard to halogen composition distribution in the interior of the silver halide emulsion grain, there can be used uniform structure grains in which the halogen composition is uniform throughout the grain; integral layer grains in which a core in the interior of the silver halide grain and a shell (composed of a single layer or a plurality of layers) surrounding the core are different in halogen composition from each other; and grains having such a structure that the grain has a non-laminar area having a different halogen composition in the interior of the grain or on the surface thereof (when the non-laminar area is present on the surface of the grain, the grain has such a structure that the area having a different halogen composition is joined to the edge, corner or plane of the grain).

When high sensitivity is desired, it is advantageous that any one of the latter two types of grains is used rather than the uniform structure type grains. The latter two types are preferred for pressure resistance.

When silver halide grains have the above described structures, the boundary between the areas having different halogen compositions may be clear or unclear, with a mixed crystal being formed by a difference in halogen composition. There may be a continuous variation in the structure of the boundary.

High silver chloride emulsions can be preferably used for photographic materials suitable for use in rapid processing. These high silver chloride emulsions have a silver chloride content of preferably not lower than 90 mol %, more preferably not lower than 95 mol %.

The high silver chloride emulsions preferably have such a structure that silver bromide-localized layers in a laminar or non-laminar form exist in the interiors of the silver halide grains and/or on the surfaces thereof. The localized layers preferably have such a halogen composition that the silver bromide content thereof is at least 10 mol %, more preferably higher than 20 mol %. These localized layers may exist in the interiors of the grains or on the edges, corners or planes of the surfaces of the grains. In a preferred embodiment, the localized layers are formed by epitaxial growth on the corners of the grains.

Even when high silver chloride emulsions having a silver chloride content of not lower than 90 mol % are used, uniform structure type grains having a narrow silver halide composition distribution within grains can also be preferably used to prevent sensitivity from being lowered as much as possible when pressure is applied to photographic materials.

The silver chloride content of the silver halide emulsion can be further increased to reduce the replenishment rates of developing solutions. In this case, emulsions comprising nearly pure silver chloride having a silver chloride content of 98 to 100 mol % can be preferably used.

Silver halide grains contained in the silver halide emulsions for use in the present invention have a mean grain size (the diameter of the grain is defined as the diameter of a circle having an area equal to the projected area of the grain, and the average of the diameters is referred to as mean grain size) of preferably 0.1 to 2 μm.

The grain size distribution in terms of a coefficient of variation (a value obtained by dividing the standard deviation of grain size by the mean grain size) is preferably not higher than 20%. Monodisperse grains having a coefficient of variation of not higher than 15% is more preferred. Monodisperse grains may be blended in the same layer, or may be coated in the form of a multilayer to obtain a wide latitude.

The silver halide grains contained in the photographic emulsions may have a regular crystal form such as a cube, a tetradecahedron or an octahedron, an irregular crystal form such as a sphere or a platy (tabular) form, or a composite form of these crystal forms. A mixture of grains having various crystal forms may be used. In the present invention, it is preferred that grains have such a crystal form distribution that at least 50%, preferably at least 70%, more preferably at least 90% thereof is composed of grains having said regular crystal form.

Further, an emulsion can be preferably used wherein tabular grains having an aspect ratio (a ratio of diameter (in terms of a diameter of a circle) to thickness) of not lower than 5, preferably not lower than 8 account for more than 50% of the projected area of the entire grains.

Silver chlorobromide emulsions which can be used in the present invention can be prepared according to the methods described in P. Glafkides, *Chimie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). Namely, any of the acid process, the neutral process and the ammonia process can be used.

A soluble silver salt and a soluble halide can be reacted in accordance with a single jet process, a double jet process or a combination thereof. A reverse mixing method can be used in which grains are formed in the presence of excess silver ion. A controlled double jet process can be used in which the pAg in a liquid phase, in which silver halide is formed, is kept constant. According to this process, a silver halide emulsion in which the crystal form is regular and grain sizes are nearly uniform can be obtained.

Various polyvalent metal ion impurities can be introduced into the silver halide emulsions for use in the present invention during the course of the formation of grains or physical ripening. Examples of compounds which can be used include cadmium salts, zinc salts, lead salts, copper salts, thallium salts and salts or complex salts of Group VIII elements such as iron, ruthenium, rhodium, palladium, osmium, iridium and platinum. Group VIII elements are particularly preferred. The amounts of these compounds to be added widely vary depending on purpose, but are preferably $10^{-9}$ to $10^{-2}$ mol per mol of silver halide.

The silver halide emulsions for use in the present invention are generally chemically sensitized and spectrally sensitized.

Examples of chemical sensitization methods include sulfur sensitization such as a typical sensitization method in which unstable sulfur compounds are added, selenium sensitization, noble metal sensitization such as typically gold sensitization and reduction sensitization. These sensitization methods may be used either alone or in combination. Examples of compounds which can be preferably used for chemical sensitization are described in JP-A-62-215272 (page 18, lower side of right column to page 22, upper side of right column).

Spectral sensitization is carried out to impart spectral sensitivity in a desired light wavelength region to the emulsion of each layer of the photographic material of the present invention. It is preferred that spectral sensitization is carried out by adding dyes which absorb light in the region of light wavelength corresponding to the desired spectral sensitivity, namely, by adding spectral sensitizing dyes. Examples of spectral sensitizing dyes which can be used include compounds described in F. M. Harmer, *Heterocyclic compounds-Cyanine dyes and related compounds* (John Wiley & Sons, New York, London 1964). Preferred examples of compounds and spectral sensitization methods are described in the aforesaid JP-A-62-215272 (page 22, upper side of right column to page 38). The spectral sensitizing dyes may be added in the emulsion having been added the sensitizing dye of formula (I).

The silver halide emulsions for us in the present invention may contain various compounds or precursors thereof to prevent fogging during the course of the preparation or storage of the photographic materials or during processing or to stabilize photographic performance. Compounds described in the aforesaid JP-A-62-215272 (page 39 to page 72) can be preferably used.

Examples of anti-fogging agents or stabilizers include thiazoles such as benzthiazolium salts described in U.S. Pat. Nos. 3,954,478 and 4,942,721 and JP-A-59191032, ring-opened nitroindazoles, triazoles, benztriazoles and benzimidazoles (particularly nitro- or halogen-substituted compounds) described in JP-B-5426731; heterocyclic mercapto compounds such as mercaptothiazoles, mercaptobenzthiazoles, mercaptobenzimidazoles, mercaptothiadiazoles, mercaptotetrazoles (particularly, 1-phenyl-5-mercaptotetrazole), mercaptopyrimidine; heterocyclic mercapto compounds having a water-soluble group such as a carboxyl group or a sulfo group; thioketone compounds such as oxazolinethione; azaindenes such as tetrazaindenes (particularly 4-hydroxy-substituted (1,3,3*a*,7)-tetrazaindenes); benzenethiosulfonic acids; and benzenesulfinic acid.

The photographic materials of the present invention may contain colloidal silver and dyes to prevent irradiation and halation and particularly to ensure the separation of spectral sensitivity distribution of each sensitive layer and safety to safelight.

Examples of the dyes include oxonol dyes having a pyrazolone nucleus, barbituric nucleus or barbituric acid nucleus described in U.S. Pat. Nos. 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-3922069, JP-B-43-13168, JP-A-62-273527, U.S. Pat. Nos. 3,247,127, 3,469,985 and 4,078,933; other oxonol dyes described in U.S. Pat. Nos. 2,533,472 and 3,379,533, U.K. Patent 1,278,621, JP-A-1-134447 and JP-A-1-183652; azo dyes described in U.K. Patents 575,691, 680,631, 599,623, 786,907, 907,125 and 1,045,609, U.S. Pat. No. 4,255,326 and JP-A-59-211043; azomethine dyes described in JP-A-50-100116, JP-A-54-118247, U.K. Patents 2,014,598 and 750,031; anthraquinone dyes described in U.S. Pat. No. 2,865,752; arylidene dyes described in U.S. Pat. Nos. 2,538,009, 2,688,541 and 2,538,008, U.K. Patents 584,609 and 1,210,252, JP-A-50-40625, JP-A-51-3623, JP-A-51-10927, JP-A-54-118247, JP-B-48-3286 and JP-B-59-7303; styryl dyes described in JP-B-28-3082, JP-B-44-6594 and JP-B-59-28898; triarylmethane dyes described in U.K. Patents 446,538 and 1,335,422 and JP-A-59-28250; merocyanine dyes described in U.K. Patents 1,075,653, 1,153,341, 1,284,730, 1,475,228 and 1,542,807; and cyanine dyes described in U.S. Pat. Nos. 2,843,486 and 3,294,539 and JP-A-1-291247.

Methods for preventing these dyes from diffusing include the following methods.

One method, for example, introduces a ballast group into the dye to make the dye nondiffusing.

Further, methods in which a hydrophilic polymer having an opposite charge to the dissociated anionic dye is present as a mordant in the same layer to localize the dye in a specific layer by an interaction with the dye molecule, are disclosed in U.S. Pat. Nos. 2,548,564, 4,124,386 and 3,625,694.

Methods for dyeing a specific layer with a water-insoluble dye solid are disclosed in JP-A-56-12639, JP-A-55-155350, JP-A-55-155351, JP-A-63-27838, JP-A-63-19794 and European Patent 15,601.

Methods for dyeing a specific layer by using fine particles of a metal salt containing a dye adsorbed thereon are described in U.S. Pat. Nos. 2,719,088, 2,496,841 and 2,496,843 and JP-A-60-45237.

Any surface latent image emulsion in which a latent image is predominantly formed on the surface of the grain or internal latent image emulsion in which a latent image is predominantly formed in the interior of the grain, can be used as the emulsion for use in the present invention.

When the present invention is applied to color photographic materials, there are generally used yellow couplers forming yellow color, magenta couplers forming magenta color and cyan couplers forming cyan color, each of them forming each color by coupling with an oxidation product of an aromatic amine developing agent.

Cyan couplers, magenta couplers and yellow couplers which can be preferably used in the present invention are compounds represented by the following general formulas (C-I), (C-II), (M-I), (M-II) and (Y).

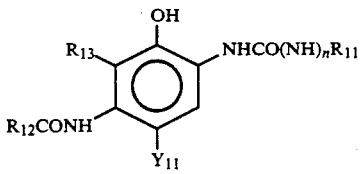

(C-I)

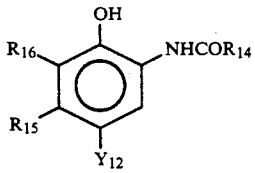

(C-II)

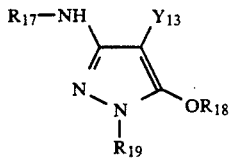

(M-I)

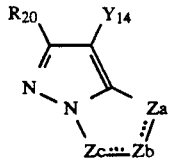

(M-II)

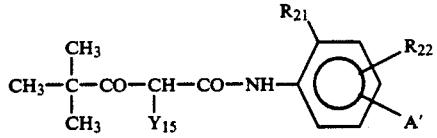

(Y)

In general formulas (C-I) and (C-II), $R_{11}$, $R_{12}$ and $R_{14}$ each represents a substituted or unsubstituted aliphatic, aromatic or heterocyclic group; $R_{13}$, $R_{15}$ and $R_{16}$ each represents a hydrogen atom, a halogen atom, an aliphatic group, an aromatic group or an acylamino group, or $R_{13}$ and $R_{12}$ may each represents a non-metallic atomic group required for forming a nitrogen-containing five-membered or six-membered ring; $Y_{11}$ and $Y_{12}$ each represents a hydrogen atom or a group which is eliminated by a coupling reaction with an oxidation product of a developing agent; and n represents 0 or 1.

In formula (C-II), $R_{15}$ is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butaneamidomethyl or methoxymethyl.

Preferred examples of the cyan couplers represented by formula (C-I) or (C-II) are the following compounds.

In formula (C-I), $R_{11}$ is preferably an aryl group or a heterocyclic group, more preferably an aryl group substituted by one or more of a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and cyano group.

When $R_{13}$ and $R_{12}$ in formula (C-I) are not combined together to form a ring, $R_{12}$ is preferably a substituted or unsubstituted alkyl or aryl group with a substituted aryloxy-substituted alkyl group being more preferred, and $R_{13}$ is preferably a hydrogen atom.

In formula (C-II), $R_{14}$ is preferably a substituted or unsubstituted alkyl or aryl group with a substituted aryloxy-substituted alkyl group being particularly preferred.

In formula (C-II), $R_{15}$ is preferably an alkyl group having 2 to 15 carbon atoms or a methyl group having a substituent group having one o more carbon atoms. Preferred examples of the substituent group include an arylthio group, an alkylthio group, an acylamino group, an aryloxy group and an alkyloxy group.

In formula (C-II), $R_{15}$ is more preferably an alkyl group having 2 to 15 carbon atoms, and particularly preferably an alkyl group having 2 to 4 carbon atoms.

In formula (C-II), $R_{16}$ is preferably a hydrogen atom or a halogen atom with a chlorine atom and fluorine atom being particularly preferred. In formulas (C-I) and (C-II), $Y_{11}$ and $Y_{12}$ each is preferably a hydrogen atom, a halogen atom, an alkoxy group, an aryloxy group, an acyloxy group or a sulfonamido group.

In formula (M-I), $R_{17}$ and $R_{19}$ each represents a substituted or unsubstituted aryl group; $R_{18}$ represents a hydrogen atom, an aliphatic or aromatic acyl group or an aliphatic or aromatic sulfonyl group; and $Y_{13}$ represents a hydrogen atom or an eliminable group. Examples of substituent groups for the aryl group (preferably a phenyl group) represented by $R_{17}$ and $R_{19}$ are the same as those set forth in the definition of the substituent groups for $R_{11}$ in formula (C-I). When the aryl group has two or more substituent groups, they may be the same or different groups. $R_{18}$ is preferably a hydrogen atom or an aliphatic acyl or sulfonyl group with a hydrogen atom being particularly preferred.

Preferably, $Y_{13}$ is a group which is eliminated through a sulfur, oxygen or nitrogen atom. For example, a type of a group which is eliminated through sulfur atom as described in U.S. Pat. No. 4,351,897 and WO 88/04795 is particularly preferred.

In formula (M-II), $R_{20}$ represents a hydrogen atom or a substituent group; $Y_{14}$ represents a hydrogen atom or an eliminable group with a halogen atom or an arylthio group being particularly preferred. Za, Zb and Zc each represents a methine group, a substituted methine group, =N— or —NH—, and one of the Za-Zb bond and Zb-Zc bond is a double bond and the other is a single bond. When the Zb-Zc bond is a carbon-to-carbon double bond, the bond may form a moiety of an aromatic ring. A dimer or a higher polymer may be formed through $R_{20}$ or $Y_{14}$. Further, when Za, Zb or Zc is a substituted methine group, a dimer or a higher polymer may be formed through the substituted methine group.

Among the pyrazoloazole couplers represented by formula (M-II), imidazo[1,2-b]pyrazoles described in U.S. Pat. No. 4,500,630 are preferred for fastness to light and low degree of secondary yellow absorption of the developed dyes. Pyrazolo[1,5-b][1,2,4]triazoles described in U.S. Pat. No. 4,540,654 are particularly preferred.

Other preferred examples of pyrazoloazole couplers include pyrazolotriazole couplers where a branched alkyl group is attached directly to the 2, 3 or 6-position of a pyrazolotriazole ring described in JP-A-61-65245; Pyrazoloazole couplers having a sulfonamido group described in JP-A-61-65246, pyrazoloazole couplers having an alkoxyphenylsulfonamido ballast group described in JP-A-61-147254 and pyrazolotriazole couplers having an alkoxy group or an aryloxy group at the 6-position described in EP-A-226849 and EP-A-294785.

In formula (Y), $R_{21}$ represents a halogen atom, an alkoxy group, a trifluoromethyl group or an aryl group; $R_{22}$ represents a hydrogen atom, a halogen atom or an alkoxy group; A' represents —$NHCOR_{23}$, —$NHSO_2$—$R_{23}$, —$SO_2NHR_{23}$, —$COOR_{23}$ or $$-SO_2\underset{\underset{R_{24}}{|}}{N}-R_{23};$$

$R_{23}$ and $R_{24}$ each represents an alkyl group, an aryl group or an acyl group; and $Y_{15}$ represents an eliminable group. Examples of substituent groups for $R_{22}$, $R_{23}$ and $R_{24}$ are the same as those set forth in the definition of the substituent groups for $R_{11}$. Preferably, $Y_{15}$ is a type of a group which is eliminated through an oxygen atom or a nitrogen atom. A group which is eliminated through a nitrogen atom is particularly preferred.

Examples of the couplers represented by general formulas (C-I), (C-II), (M-I), (M-II) and (Y) include the following compounds.

(C-1)

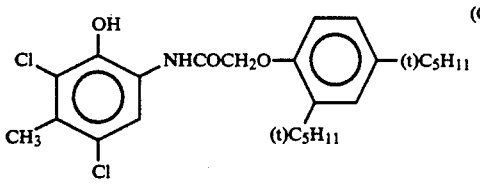

(C-2)

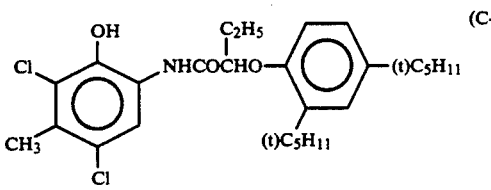

-continued (C-3)

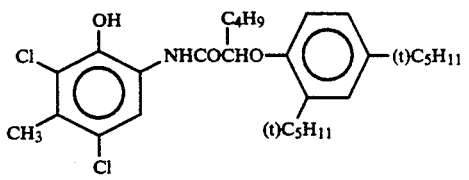

(C-4)

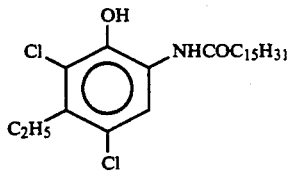

(C-5)

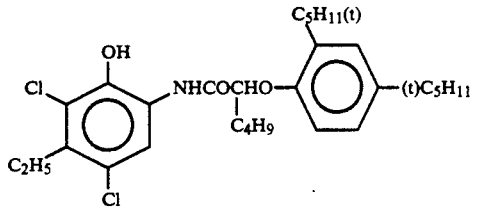

(C-6)

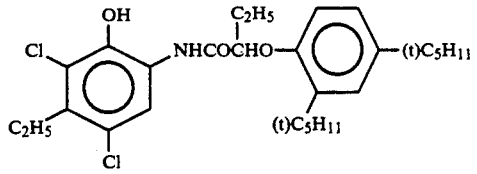

(C-7)

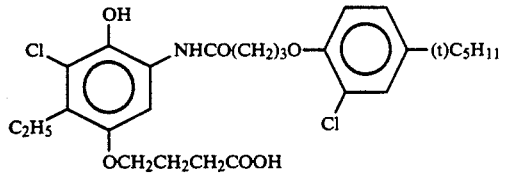

(C-8)

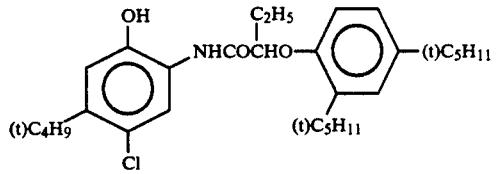

(C-9)

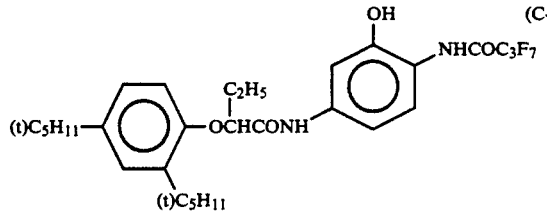

(C-10)

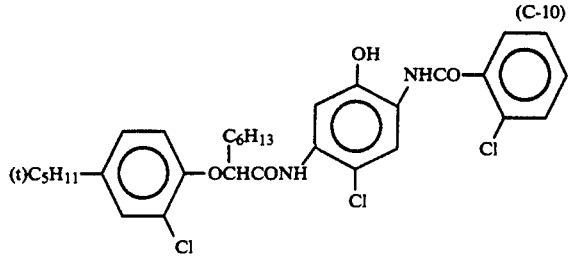

-continued
(C-11)
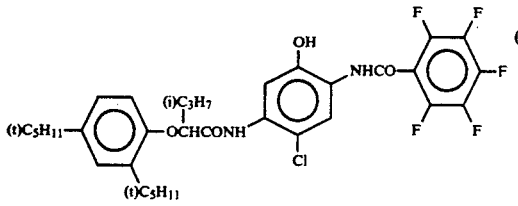
(C-12)
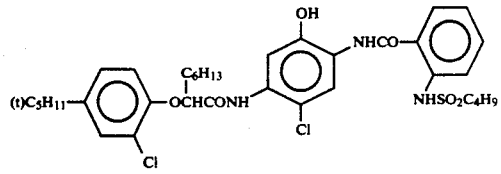
(C-13)
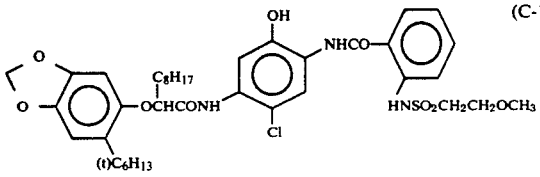
(C-14)
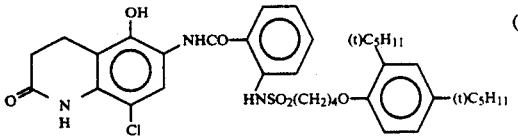
(C-15)
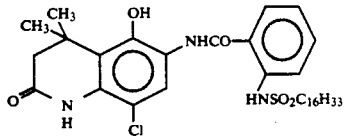
(C-16)
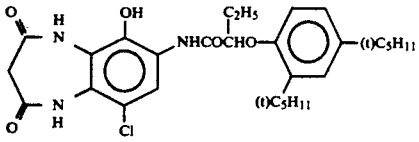
(C-17)
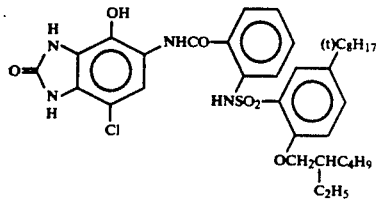
-continued
(C-18)
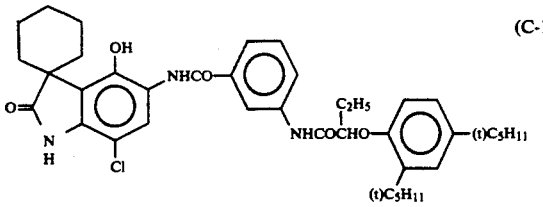
(C-19)
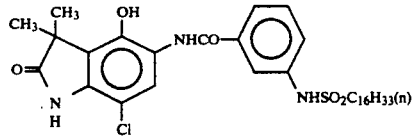
(C-20)
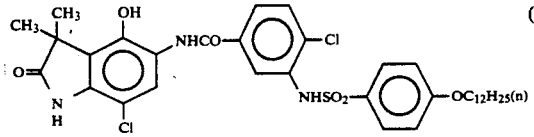
(C-21)
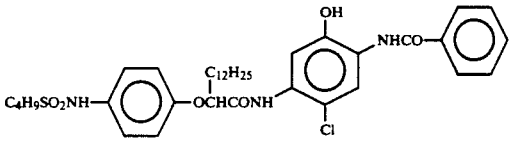
(C-22)
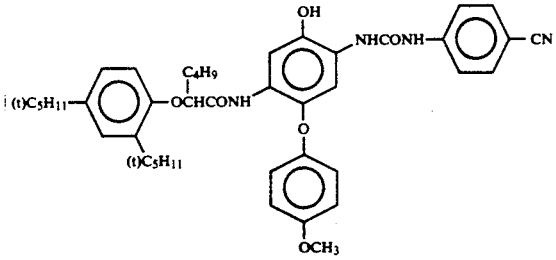
(M-1)
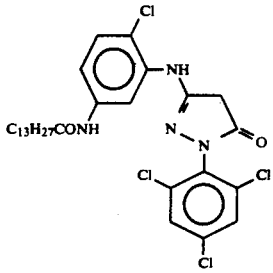

-continued
(M-2)
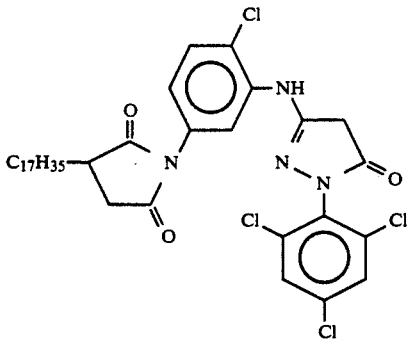
(M-3)
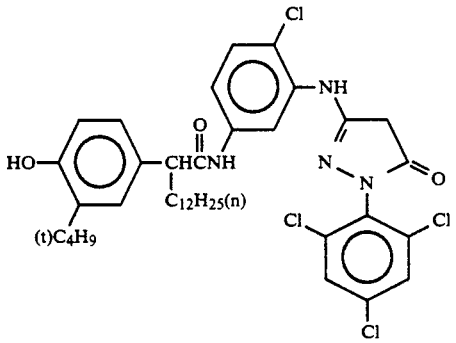
(M-4)
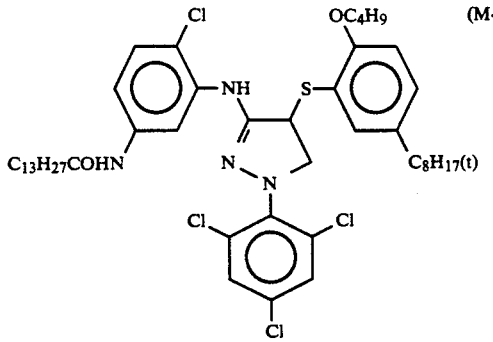
-continued
(M-5)
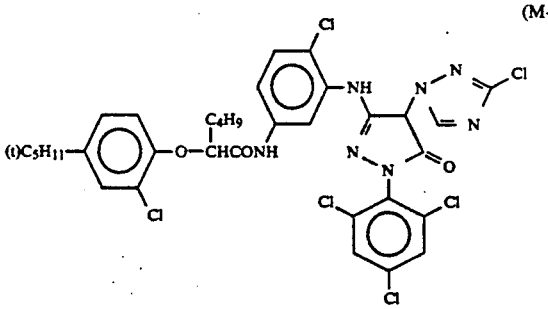
(M-6)
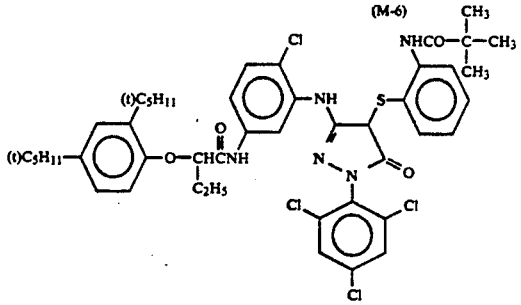
(M-7)
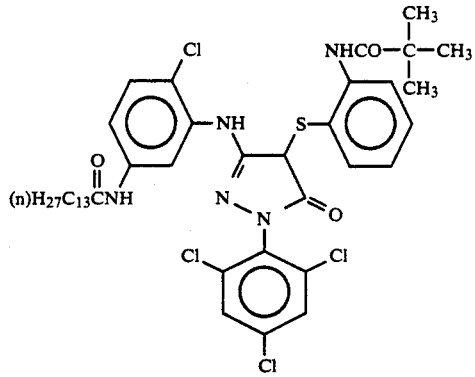
(M-8)
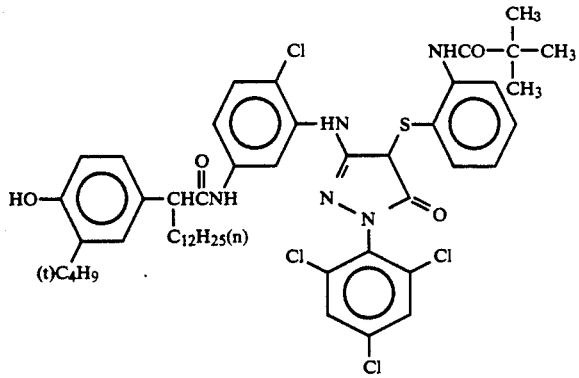

| Compound | $R_{10}$ | $R_{15}$ | $Y_4$ |
|---|---|---|---|
| | | 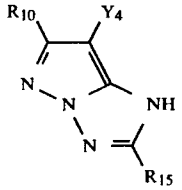 | |
| M-9 | $CH_3$— | 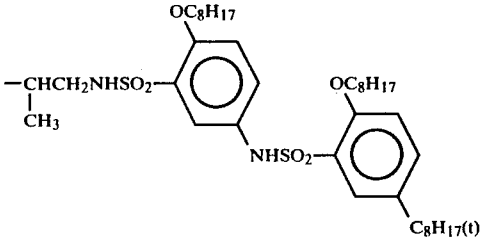 | Cl |
| M-10 | $CH_3$— | 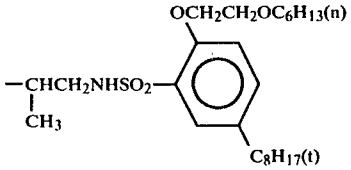 | Cl |
| M-11 | $(CH_3)_3C$— | 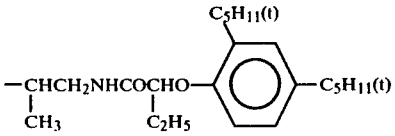 | 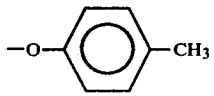 |
| M-12 | 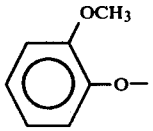 | 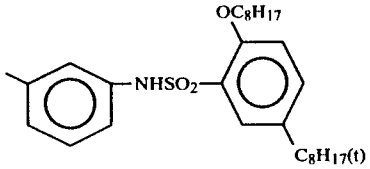 | 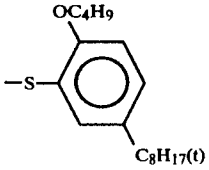 |

-continued
| Compound | $R_{10}$ | $R_{15}$ | $Y_4$ |
|---|---|---|---|
| M-13 | $CH_3$— | 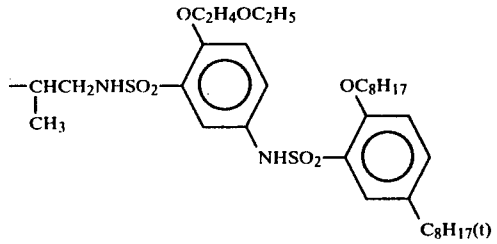 | Cl |
| M-14 | $CH_3$— | 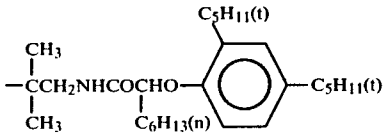 | Cl |
| M-15 | $CH_3$— | 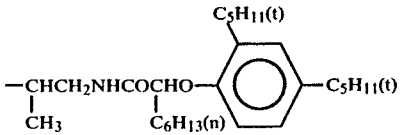 | Cl |
| M-16 | $CH_3$— | 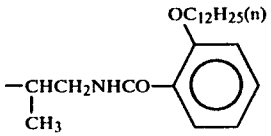 | Cl |
| M-17 | $CH_3$— | 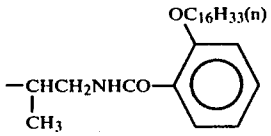 | Cl |

-continued
| Compound | $R_{10}$ | $R_{15}$ | $Y_4$ |
|---|---|---|---|
| M-18 | 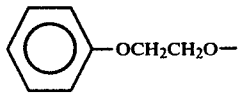 | 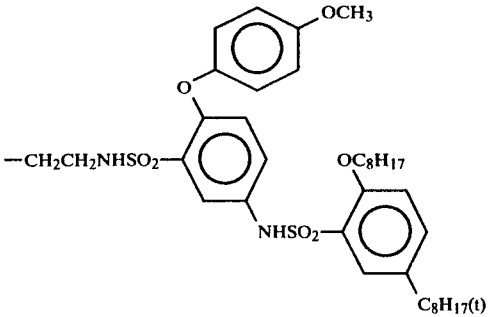 | 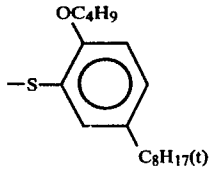 |
| M-19 | $CH_3CH_2O-$ | 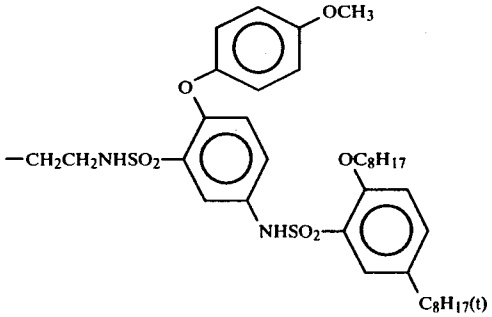 | 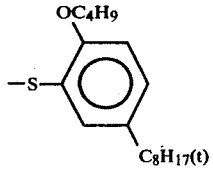 |
| M-20 | 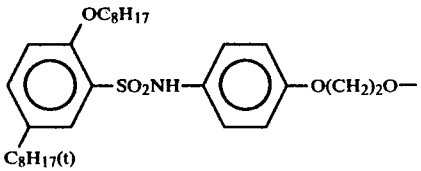 | 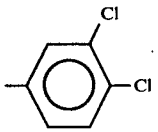 | 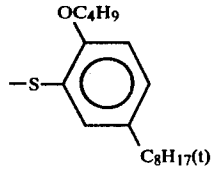 |
| M-21 | 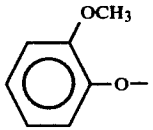 | 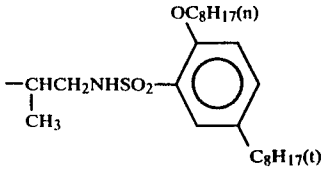 | Cl |

-continued
| Compound | $R_{10}$ | $R_{15}$ | $Y_4$ |
|---|---|---|---|
| | | 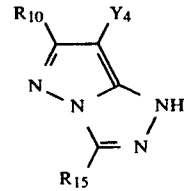 | |
| M-22 | $CH_3$— | 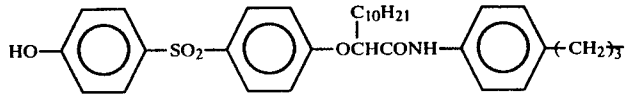 | Cl |
| M-23 | $CH_3$— | 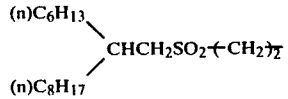 | Cl |
| M-24 | 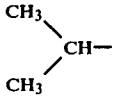 | 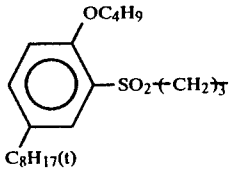 | Cl |
| M-25 | 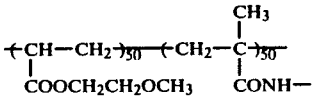 (by molar ratio) | 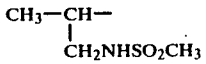 | Cl |
| M-26 | 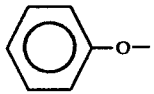 | 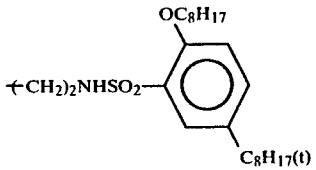 | Cl |

-continued
| Compound | $R_{10}$ | $R_{15}$ | $Y_4$ |
|---|---|---|---|
| M-27 | $CH_3$— | 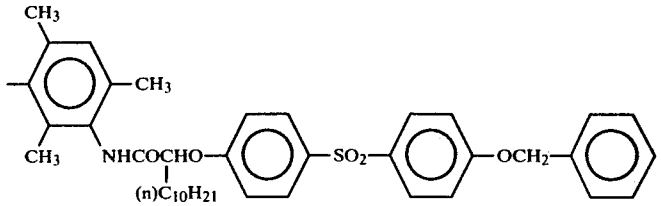 | Cl |
| M-28 | $(CH_3)_3C$— | 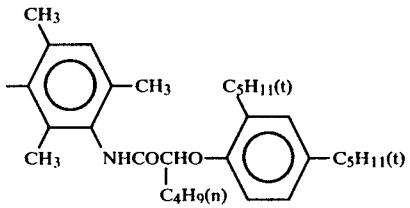 | Cl |
| M-29 | 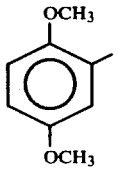 | 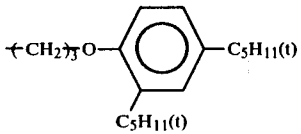 | Cl |
| M-30 | $CH_3$— | 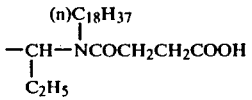 | Cl |

(Y-1)
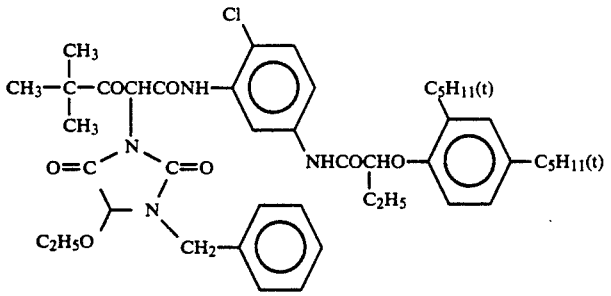
(Y-2)
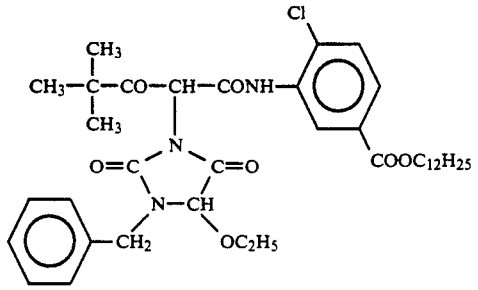
(Y-3)
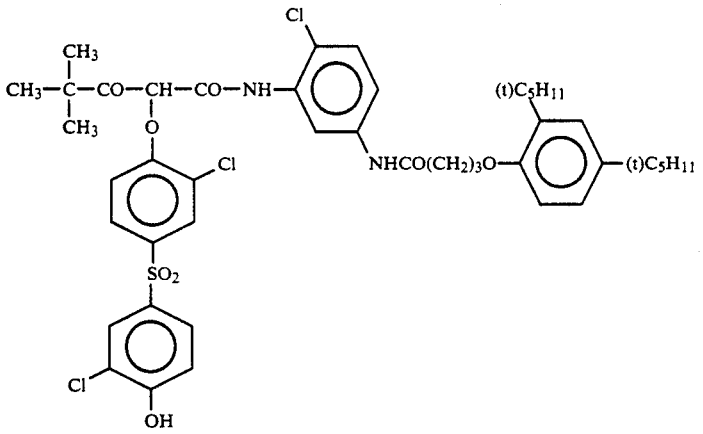
(Y-4)
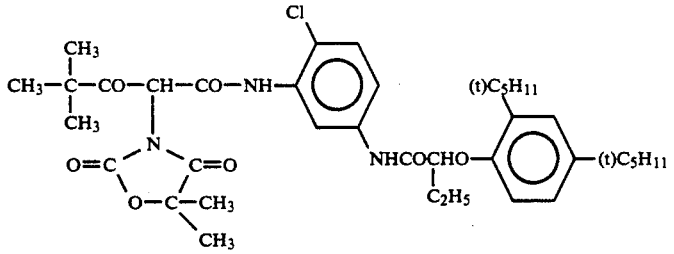
(Y-5)
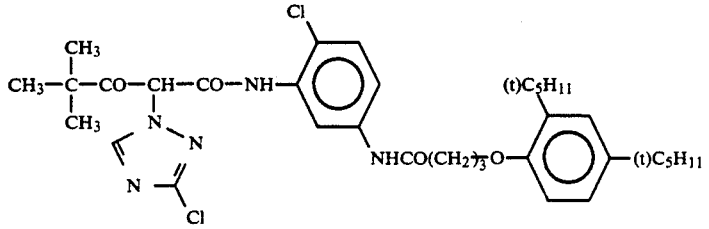

-continued (Y-6)

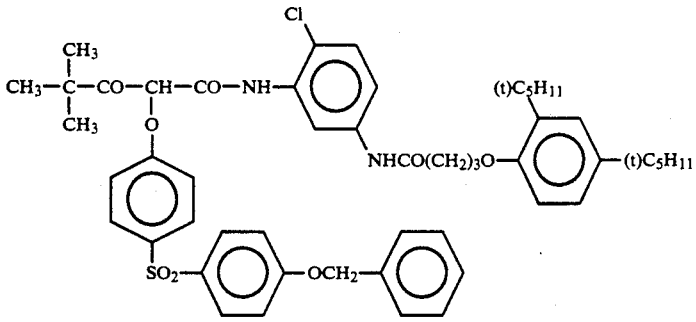

(Y-7)

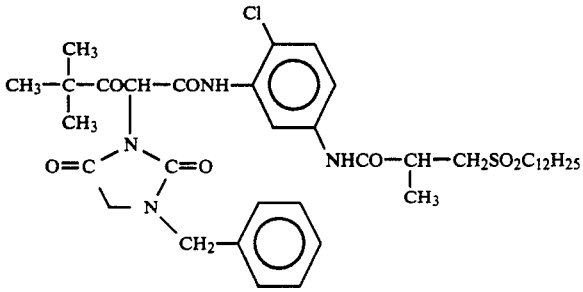

(Y-8)

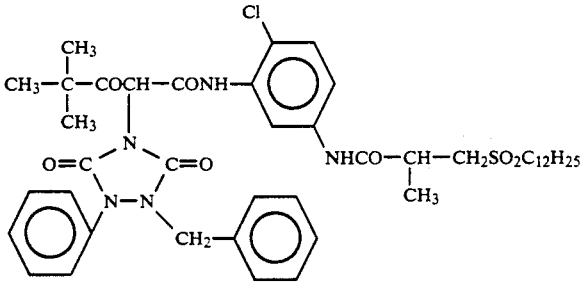

(Y-9)

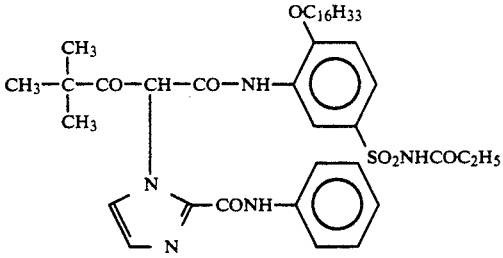

The couplers represented by formulas (C-I) to (Y) are contained in the light-sensitive silver halide emulsion layers in an amount of generally 0.1 to 1.0 mol, preferably 0.1 to 0.5 mol of coupler per mol of silver halide.

The couplers can be added to the sensitive layers by various known methods. Generally, the couplers can be added by an oil-in-water dispersion method known as the oil protect method. The couplers are dissolved in a solvent, and the resulting solution is emulsified and dispersed in an aqueous gelatin solution containing a surfactant. Alternatively, water or an aqueous gelatin solution is added to a coupler solution containing a surfactant, and an oil-in water dispersion is formed by phase inversion. Alkali-soluble couplers can be dispersed by the Fisher dispersion method. Low-boiling organic solvents are removed from the coupler dispersion by distillation, noodle washing or ultrafiltration, and the resulting coupler dispersion is mixed with the photographic emulsions.

High-boiling organic solvents having a dielectric constant (25° C.) of 2 to 20 and a refractive index (25° C.) of 1.5 to 1.7 and/or water-insoluble high-molecular compounds are preferred as dispersion mediums for the couplers.

High-boiling organic solvents represented by the following formulas (A) to (E) can be preferably used.

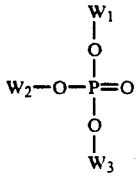

(A)

$W_1-COO-W_2$ (B)

-continued

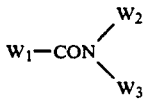
(C)

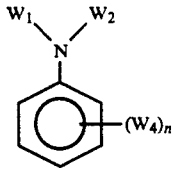
(D)

$W_1—O—W_2$ (E)

In the above formulas, $W_1$, $W_2$ and $W_3$ each is a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or greater, plural $W_4$'s may be the same or different groups. In formula (E), $W_1$ and $W_2$ may be combined together to form a condensed ring.

In addition to the above-described high-boiling organic solvents of formulas (A) to (E), water-immiscible compounds having a melting point of not higher than 100° .C and a boiling point of not lower than 140° C. can be used, so long as the compounds are good solvents for the couplers. The high-boiling organic solvents have a melting point of preferably not higher than 80° C. and a boiling point of preferably not lower than 160° C., more preferably not lower than 170° C.

The details of the high-boiling organic solvents are described in the specification of JP A-62-215272 (lower side of right column of page 137 to upper side of right column of page 144).

The couplers can be impregnated with a latex polymer (e.g., described in U.S. Pat. No. 4,203,716) in the presence or absence of the high-boiling organic solvent, or dissolved in a water-insoluble, but organic solvent-soluble polymer and can be emulsified in an aqueous solution of hydrophilic colloid. Preferably, homopolymers or copolymers described in WO 88/00723 (pages 12 to 30) are used. Particularly, acrylamide polymers are preferred for dye image stability.

The photographic materials prepared by the present invention may contain hydroquinone derivatives, aminophenol derivatives, gallic acid derivatives and ascorbic acid derivatives as color fogging inhibitors (antifogging agents).

The photographic materials of the present invention may contain various anti-fading agents. Examples of the anti-fading agents for cyan, magenta and/or yellow images include hydroquinones, 6-hydroxychromans, 5-hydroxycoumarans, spirochromans, hindered phenols such as bisphenols and p-alkoxyphenols, gallic acid derivatives, methylanedioxybenzenes, aminophenols, hindered amines and ethers or ester derivatives obtained by silylating or alkylating phenolic hydroxyl group of the above-described compounds. Further, metal complexes such as (bissalicylaldoximato)nickel complex and (bis-N,N-dialkyldithiocarbamato)nickel complex can also be used.

Examples of the organic anti-fading agents includes hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxycoumarans and spirochromans described in U.S. Pat. No. 3,432,300, 3,573,050, 3,574,627, 3,698,909 and 3,764,337 and JP-A-52-152225; spiroindanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. No. 3,700,455 and 4,228,235, JP-A-52-72224 and JP-B-52-6623; gallic acid derivatives, methylenedioxybenzenes and aminophenols described in U.S. Pat. Nos. 3,457,079 and 4,332,886 and JP-B-56-21144; hindered amines described in U.S. Pat. Nos. 3,336,135 and 4,268,593, U.K. Patents 1,326,889, 1,354,313 and 1,410,846, JP-B-51-1420, JP A-58-114036, JP-A-59-53846 and JP-A-59-78344; and metal complexes described in U.S. Pat. Nos. 4,050,938 and 4,241,155 and U.K. Patent 2,027,731 (A).

The anti-fading agents are generally used in an amount of 5 to 100% by weight based on the amount of the corresponding color coupler. These compounds can be coemulsified with the couplers and added to the emulsion layers.

It is preferred that an ultraviolet light absorbing agent is introduced into the cyan color forming layer and both layers adjacent to the cyan color forming layer to prevent cyan color images from being deteriorated by heat and particularly light.

Examples of the ultraviolet light absorbing agents include aryl group-substituted benztriazole compounds described U.S. Pat. No. 3,533,794; 4-thiazolidone compounds described in U.S. Pat. Nos. 3,314,794 and 3,352,681; benzophenone compounds described in JP-A-46-2784; cinnamic ester compounds described in U.S. Pat. Nos. 3,705,805 and 3,707,395; butadiene compounds described in U.S. Pat. No. 4,045,229; and benzoxazol compounds described in U.S. Pat. Nos. 3,406,070, 3,677,672 and 4,271,307. If desired, ultraviolet light absorbing couplers (e.g., α-naphthol cyan color forming couplers) and ultraviolet light absorbing polymers may be used. These ultraviolet light absorbers may be incorporated in specific layers.

Of the above ultraviolet light absorbers, the aryl group-substituted benztriazole compounds are preferred.

It is preferred that the following compounds are used in combination with the above-described couplers, particularly with the pyrazoloazole couplers.

Specifically, it is preferred that a compound (F) and/or a compound (G) are/is used. Compound (F) is a compound which forms a chemical bond with an aromatic amine developing agent left behind after color development to form a compound which is substantially colorless and chemically inert. Compound (G) is a compound which forms a chemical bond with an oxidation product of an aromatic amine developing agent left behind after color development to form a compound which is substantially colorless and chemically inert. When these compounds (F) and (G) are used either alone or in combination, the formation of stain due to developed dyes formed by the reaction of the couplers with the color developing agents or the oxidation products thereof left behind in the layers and other side effects can be prevented from being caused during storage after processing.

Compounds having a second-order reaction constant $k_2$ at 80° C. in trioctyl phosphate (in terms of the reaction with p-anisidine) of from 1.0 to $1\times10^{-5}$ l/mol·sec are preferred as the compound (F). The second-order reaction constant can be measured by the method described in JP-A-63-158545.

When $k_2$ is greater than the above upper value, the compounds themselves become unstable, and there is a possibility that the compounds will react with gelatin or water and as a result, will be decomposed. When $k_2$ is smaller than the above lower value, the reaction of the compounds with the aromatic amine developing agents left behind is retarded, and as a result, there is a possibility that side effects caused by the aromatic amine developing agents left behind can not be prevented.

Of the compounds (F), compounds represented by the following formula (FI) or (FII) are preferred.

$$R_1-(A)_n-X \quad \text{(FI)}$$

$$R_2-\underset{\underset{B}{|}}{C}=Y \quad \text{(FII)}$$

In these formulas, $R_1$ and $R_2$ each represents an aliphatic group, an aromatic group or a heterocyclic group; n represents 0 or 1; A represents a group which reacts with an aromatic amine developing agent to form a chemical bond; X represents a group which is eliminated by the reaction with the aromatic amine developing agent; B represents a hydrogen atom, an aliphatic group, an aromatic group, a heterocyclic group, an acyl group or a sulfonyl group; and Y represents a group which accelerates the addition of the aromatic amine developing agent to the compound of formula (FII). $R_1$ and X, and Y and $R_2$ or B may be combined together to form a ring structure.

Typical examples of reactions for chemically bonding these compounds (FI) and (FII) to the aromatic amine developing agents are a substitution reaction and an addition reaction.

Preferred examples of the compounds of formulas (FI) and (FII) are described in JP-A-63-158545, JP-A-62-283338, EP-A-298321 and EP-A-277589.

Of the compounds (G) which chemically bond to an oxdation product of the aromatic amine developing agents left behind after color development to form a compound which is chemically inert and substantially colorless, compounds represented by the following formula (GI) are more preferred.

$$R-Z \quad \text{(GI)}$$

In formula (GI), R represents an aliphatic group, an aromatic group or a heterocyclic group; and Z represents a nucleophilic group or a group which is decomposed in the photographic material to release a nucleophilic group. Preferred of the compounds of formula (GI) are those compounds where Z is a group having a Pearson's $^nCH_3I$ value [R. G. Pearson, et al., *J. Am. Chem. Soc.*, 90, 319 (1968)] of 5 or above or a group derived therefrom.

Preferred examples of the compounds of formula (GI) are described in EP-A-255722, JP-A-62-143048, JP-A-62-229145, Japanese Patent Application Nos. 63-136724 and 62-214681 (corresponding to JP-A-1-230039 and JP-A-1-57259, respectively) and EP-A-298321 and EP-A-277589.

The details of the combinations of the compounds (G) with the compounds (F) are described in EP-A-277589.

The hydrophilic colloid layers of the photographic materials of the present invention may contain water-soluble dyes (or dyes which are made water soluble by photographic processing) as filter dyes or for the purposes of preventing irradiation, halation, etc.

Examples of the dyes include oxonol dyes, hemioxonol dyes, styryl dyes, merocyanine dyes, cyanine dyes and azo dyes. Of these, oxonol dyes, hemioxonol dyes and merocyanine dyes are preferred.

Gelatin is preferred as a binder or protective colloid for the emulsion layers of the photographic materials of the present invention. In addition, hydrophilic colloid alone or in combination with gelatin can be used.

In the present invention, lime-processed gelatin or acid-processed gelatin can be used. The preparation of gelatin is described in more detail in Arthur Weiss, *The Macromolecular Chemistry of Gelatin* (Academic Press, 1964).

Transparent films such as cellulose nitrate film and polyethylene terephthalate film or reflection supports can be used as the support in the present invention. For the purpose of the present invention, the reflection support is preferable.

The term "reflection support" as used herein refers to supports which enhance reflection properties to make a dye image formed on the silver halide emulsion layer clear. Examples of the reflection support include supports coated with a hydrophobic resin containing a light reflecting material such as titanium oxide, zinc oxide, calcium carbonate or calcium sulfate dispersed therein, and supports composed of a hydrophobic resin containing a light reflecting material dispersed therein. Typical examples of the supports include baryta paper, polyethylene coated paper, polypropylene synthetic paper, transparent supports coated with a reflecting layer or containing a reflection substance, such as a glass sheet, a polyester film such as polyethylene terephthalate film, cellulose triacetate or cellulose nitrate, a polyamide film, a polycarbonate film, a polystyrene film and a vinyl chloride resin.

Other examples of reflection support include supports having a metallic surface having mirror reflectivity or diffuse reflectivity. The metallic surface preferably has a spectral reflectance of not lower than 0.5 in the visible wavelength region. It is desirable that the metallic surface is roughened or is made diffuse reflective by using metal powder. Examples of such metal include aluminum, tin, silver, magnesium and alloys thereof. The surface may be a surface of a metal sheet obtained by rolling, metallizing or plating a metal foil or thin metal layer. A metallic surface obtained by depositing metal on a substrate is preferred. It is preferred that a water-resistant resin layer, particularly a thermoplastic resin layer is provided on the metallic surface. It is also preferred that an antistatic layer is provided on the side of the support opposite to the side having the metallic surface. The details of such supports are described in JP-A-61-210346, JP-A-63-24247, JP-A-63-24251 and JP-A-63-24255. These supports can be properly chosen according to purpose.

It is preferred that as the reflecting substance, a white pigment is thoroughly kneaded in the presence of a surfactant or the surfaces of pigment particles are treated with a dihydric, trihydric, or tetrahydric alcohol.

The occupied area ratio (%) of fine particles of white pigment per unit area can be determined by dividing an observed area into adjoining unit areas (each unit area: 6 $\mu m \times 6$ $\mu m$) and measuring the occupied area ratio (%) (Ri) of the fine particles projected on the unit area. A coefficient of variation of the ($S/\bar{R}$) of standard deviation S of Ri to the mean value ($\bar{R}$) of Ri. The number (n) of divided unit areas is preferably not smaller than 6. Accordingly, a coefficient of variation $S/\bar{R}$ can be determined by the following formula.

$$\sqrt{\frac{\sum_{i=1}^{n}(R_i-\bar{R})^2}{n-1}} \Big/ \frac{\sum_{i=1}^{n} R_i}{n}$$

In the present invention, a coefficient of variation of the occupied area ratio (%) of the fine pigment particles is preferably not higher than 0.15, particularly not higher than 0.12. When the value is not higher than 0.08, the dispersion of the particles is considered substantially uniform.

The color developing solutions which can be used for processing the photographic materials of the present invention are preferably aqueous alkaline solutions mainly composed of aromatic primary amine color developing agents. Aminophenol compounds are useful a the color developing agents and p-phenylenediamine compounds are preferred as the color developing agents. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. These compounds may be used either alone or in combination of two or more of them.

Generally, the color developing solutions contain pH buffering agents such as alkali metal carbonates and phosphates, restrainers such as bromides, iodides, benzimidazoles, benzothiazoles and mercapto compounds and antifogging agents. If desired, the color developing solutions may optionally contain preservatives such as hydroxylamine, diethylhydroxylamine, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; color forming couplers, competitive couplers; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N', N'-tetramethylenephosphonic acid and ethylenediamidine-di(o-hydroxyphenylacetic acid) and salts thereof.

Generally, when reversal processing is to be conducted, black-and-white development is first carried out, and then color development is carried out. Black-and-white developing solutions may contain conventional black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination of two or more.

The pH of the color developing solutions and the black-and-white developing solutions is generally from 9 to 12. The replenishment rate of these developing solutions varies depending on the types of color photographic materials to be processed, but is usually not more than 3 l per $m^2$ of the photographic material. The replenishment rate can be reduced to 500 ml or less when the concentration of bromide ion in the replenisher is reduced. When the replenishment rate is reduced, it is desirable to reduce the contact area with air of the processing solution in a processing bath to prevent the solution from being evaporated or oxidized by air. The contact area with air of the processing solution in the processing bath can be represented by an opening ratio defined below.

Opening ratio = contact area ($cm^2$) of processing solution with air/volume ($cm^3$) of processing solution.

The opening ratio is preferably not higher than 0.1, more preferably 0.001 to 0.05.

Examples of methods for reducing the opening ratio include a method in which a cover such as a floating cover is provided on the surface of a photographic processing solution in a processing tank; a method using a movable cover as described in Japanese Patent Application No. 62-241342 (corresponding to JP-A-1-82033); and a slit development method described in JP-A-63-216050.

It is preferred that the reduction of the opening ratio is applied to both the color development stage and black-and-white development stage as well as all subsequent stages such as bleaching, bleach-fixing (blixing), fixing, washing and stabilizing stages.

The replenishment rate can be reduced by using a means for inhibiting the accumulation of bromide ion in the developing solution.

The color development time is generally from 2 to 5 minutes. However, the color development processing time can be shortened by using the color developing solution at a higher concentration under higher temperature and higher pH conditions.

After color development, the photographic emulsion layer is generally bleached and fixed to effect desilvering. Bleaching may be carried out simultaneously with fixing (known as bleach-fixing treatment), or may be carried out separately. After bleaching, a bleach fixing treatment may be conducted to expedite processing. Processing may be carried out by a bleach-fixing bath composed of two consecutive baths. Fixing may be conducted before the bleach-fixing treatment. After the bleach-fixing treatment, bleaching may be conducted according to purpose Examples of bleaching agents include compounds of polyvalent metals such as iron(III). Typical examples of the bleaching agents include organic complex salts of iron(III) such as complex salts of aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc. Of these, iron(III) complex salts of aminopolycarboxylic acids such as (ethylenediaminetetraacetato)iron(III) complex are preferred for rapid processing and prevention of environmental pollution. Further, iron(III) complex salts of polyaminocarboxylic acids are useful for bleaching solutions and bleach-fixing solutions. The pH of the bleaching solutions containing the iron(III) complex salts of the polyaminocarboxylic acids and the bleaching-fixing solutions containing the iron(III) complex salts is generally from 4.0 to 8. Lower pH may be used to expedite processing.

If desired, the bleaching solution, the bleach-fixing solution and a prebath thereof may contain bleaching accelerators. Examples of the bleaching accelerators include compounds having a mercapto group or disulfide bond described in U.S. Pat. No. 3,893,858, West German Patent 1,290,812, JP-A-53-95630, and Research Disclosure No. 17129 (July 1978); thiazolidine compounds described in JP-A-50-140129; thiourea compounds described in U.S. Pat. No. 3,706,561, JP-B-45-8506, JP-A-52-20832 and JP-A-53-32735; iodides described in JP-A-58-16235; polyoxyethylene compounds described in West German Patent 2,748,430; polyamine compounds described in JP-B-45-8836; and bromide ions. Of these, the compounds having a mercapto group or disulfide bond are preferred for obtaining a high bleaching accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated into the photographic materials. These bleaching accelerators are particularly effective in conducting bleach-fixing of the color photographic materials for photographing.

Examples of fixing agents include thiosulfates, thiocyanates, thioether compounds, thioureas and a large amount of iodide. Thiosulfates are widely used as fixing agents. Particularly, ammonium thiosulfate is most widely used. Sulfites, bisulfites, sulfinic acids such as p-toluenesulfinic acid, and carbonyl bisulfite adducts are preferred as preservatives for the bleach-fixing solutions.

Usually, the silver halide color photographic materials of the present invention are subjected to a washing and/or a stabilization stage after desilverization. The amount of washing water in the washing stage widely varies depending on the characteristics (e.g., depending on materials used such as couplers) of the photographic materials, the use, the temperature of the washing water, the number of washing tanks (the number of stages), the replenishing system (countercurrent, concurrent) and other conditions. The relationship between the amount of water and the number of washing tanks in the multi-stage countercurrent system can be determined by the method described in *Journal of the Society of Motion Picture and Television Engineers,* Vol. 64, p. 248-253 (May 1955).

According to the multi-stage countercurrent system described in the above Journal, the amount of washing water can be greatly reduced. However, this causes a problem in that the residence time of water in the tanks is prolonged, and as a result, bacteria grow in the tank and the resulting suspended matter is deposited on the photographic material. A method in which calcium ions and magnesium ions are reduced, described in JP-A-62-288838, can be effectively used for the color photographic materials of the present invention to solve the above-mentioned problem. Further, isothiazolone compounds, thiabendazole compounds, chlorine-containing germicides such as sodium chlorinated isocyanurate and benztriazole described in JP-A-57-8542 and germicides described in *Germicidal Antifungal Chemistry,* written by Hiroshi Horiguchi, published by Sankyo Shuppan, (1986); *Sterilization, Disinfection, Antifungal Technique of Microorganisms,* edited by Sanitary Technique Society, Kogyo Gijutsu Kai, (1982), and *Antibacterial and Antifungal Cyclopedia,* edited by Nippon Antibacterial Antifungal Society (1986), can be used.

The pH of the washing water in the treatment of the photographic materials of the present invention usually is from 4 to 9, preferably 5 to 8. The temperature of the washing water and washing time vary depending on the characteristics of the photographic materials, use, etc., but the temperature and time washing are generally 15° to 45° C. for 20 seconds to 10 minutes, preferably 25° to 40° C. for 30 seconds to 5 minutes.

The photographic materials of the present invention may be processed directly with stabilizing solutions in place of the washing water. Such a stabilizing treatment can be carried out by conventional methods described in JP-A-57-8543, JP-A-58-14834 and JP-A-60 220345.

A stabilizing treatment may be conducted subsequent to washing. The stabilizing treatment may be used as the final bath for the color photographic materials for photographing. An example thereof includes a stabilizing bath containing formalin and a surfactant. The stabilizing bath may contain various chelating agents and antifungal agents.

An overflow solution from the replenishment of a washing water and/or stabilizing stage can be reused in other stages such as a desilverization stage.

The color developing agents may be incorporated into the silver halide color photographic materials of the present invention for the purpose of simplifying and expediting processing. It is preferred that precursors for the color developing agents are used for the incorporation thereof in the photographic materials. Examples of the precursors include indoaniline compounds described in U.S. Pat. No. 3,342,597; Schiff base compounds described in U.S. Pat. No. 3,342,599, *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated into the silver halide color photographic materials of the present invention for the purpose of accelerating color development. Typical examples of the compounds include those described in JP-A-56-64339, JP-A-57-144547 and JP-A-58-115438.

In the present invention, the various processing solutions are used at a temperature of 10° to 50° C. Generally, a temperature of 33° to 38° C. is used. However, it is possible that a higher temperature may be used to accelerate processing and to shorten processing time, while a lower temperature may be used to improve image quality and to improve the stability of the processing solutions. If desired, treatments using cobalt intensification or hydrogen peroxide intensification described in West German Patent 2,226,770 and U.S. Pat. No. 3,674,499 may be carried out to save silver.

It is preferred that the photographic materials of the present invention are subjected to color development, bleach-fixing and washing treatment or (stabilizing treatment). Bleaching and fixing may be separately carried out without a bleach-fixing treatment as mentioned above.

The color developing solutions of the present invention contain conventional aromatic primary amine color developing agents. Preferred examples thereof are p-phenylenediamine compounds. Typical examples of the p-phenylenediamine compounds include, but are not limited to, the following compounds.

D-1 N,N-Diethyl-p-phenylenediamine
D-2 2-Amino-5-diethylaminotoluene
D-3 2-Amino-5-(N-ethyl-N-laurylamino)toluene
D-4 4-[N-Ethyl-N (8-hydroxyethyl)amino]aniline
D-5 2-Methyl-4-[N-ethyl-N-(8-hydroxyethyl)amino ]aniline
D-6 4-Amino-3-methyl-N-ethyl-N-[β-(methanesulfonamido)ethyl]aniline
D-7 N-(2-Amino-5-diethylaminophenylethyl)methanesulfonaminde
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline Of the above-described p-phenylenediamine comounds, 4-amino-3-methyl-N-ethyl-N-[β-(methanesulfonamido)ethyl]aniline (compound D-6) is particularly preferred.

These p-phenylenediamine compounds may be in the form of a salt such as sulfate, hydrochloride, sulfite or p-toluenesulfonate. The aromatic primary amine developing agents are used in an amount of about 0.1 to about 20 g, more preferably about 0.5 to about 10 g per liter of the developing solution.

In the practice of the present invention, it is preferred to us developing solutions containing substantially no benzyl alcohol. The term "containing substantially no benzyl alcohol" as used herein refers to a concentration of benzyl alcohol of not higher than 2 ml/l, more preferably not higher than 0.5 ml/l. Most preferably, the developing solutions are completely free from benzyl alcohol.

It is preferred that the developing solutions employed in the practice of the present invention contain substantially no sulfite ion. The sulfite ion functions as a preservative for the developing agent and at the same time, it has an effect of dissolving silver halide and lowering dye forming efficiency by reacting with an oxidation product of the developing agent. It is thought that such effect is one of the causes of increasing changes in photographic characteristics in a continuous processing. The term "contain substantially no sulfite ion" as used herein refers to a concentration of sulfite ion of preferably not higher than $3.0\times10^{-3}$ mol/l. It is most preferred that the developing solutions are completely free from sulfite ion. However, a very small amount of sulfite may be used to prevent a processing agent in a kit (in which a developing agent is contained in the form of a concentrate before a working solution is prepared) from being oxidized.

It is preferred that the developing solutions employed in the practice of the present invention contain substantially no sulfite ion as mentioned above. It is more preferred that the developing solutions of the present invention also contain substantially no hydroxylamine. This is because it is thought that hydroxylamine functions as a preservative for the developing solutions, and at the same time, hydroxylamine itself has a silver development activity, and hence photographic characteristics are greatly affected by a change in the concentration of hydroxylamine. The term "contain substantially no hydroxylamine" as used herein refers to a concentration of hydroxylamine of preferably not higher than $5.0\times10^{-3}$ mol/l. It is most preferred that the developing solutions are completely free from hydroxylamine.

It is more preferred that the developing solutions employed in the practice of the present invention contain organic preservatives in place of hydroxylamine and sulfite ion.

The term "organic preservative" as used herein refers to all organic compounds which can reduce the deterioration rate of the aromatic primary amine color developing agent when the organic compounds are added to the processing solutions for the color photographic materials. Namely, the organic preservatives are organic compounds capable of preventing the color developing agents from being oxidized by air, etc. Of these, particularly effective organic preservatives are hydroxylamine compounds (excluding hydroxylamine), hydroxamic acids, hydrazines, hydrazides, phenols, α-hydroxyketones, α-aminoketones, saccharide, monoamines, diamines, polyamines, quaternary ammonium salts, nitroxyl radicals, alcohols, oximes, diamide compounds and condensed ring type amines. These compounds are described in JP-A-63-4235, JP-A-63-30845, JP-A-63-21647, JP-A-63-44655, JP-A-63-53551, JP-A-63-43140, JP-A-63-56654, JP-A-63-58346, JP A-63-43138, JP-A-63-146041, JP-A-63-44657, JP-A-63-44656, U.S. Pat. Nos. 3,615,503 and 2,494,903, JP-A-52-143020 and JP-B-48-30496.

Examples of other preservatives which may be optionally added include various metals described in JP-A-57-44148 and JP A-57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544. In particular, the addition of alkanolamines such as triethanolamine, dialkylhydroxylamines such as diethylhydroxylamine hydrazines or aromatic polyhydroxy compounds is preferred.

Of the above-described organic preservatives, the hydroxylamine compounds and the hydrazine compounds (hydrazines and hydrazides) are particularly preferred. The details thereof are described in Japanese Patent Application Nos. 62-255270, 63-9713, 63-9714 and 63-11300 (corresponding to JP-A-1-97953, JP-A-1-186939, JP-A-1-186940 and JP-A-187557, respectively).

It is more preferred, for improving the stability of the color developing solutions and eventually improving stability during the course of continuous processing, that the above-described hydroxylamine or hydrazine compounds are used in combination with amines.

Examples of such amines include cyclic amines described in JP-A-63-239447, amines described in JP-A-3-128340 and amines described in Japanese Patent Application Nos. 63-9713 and 63-11300.

In the practice of the present invention, it is preferred that the color developing solutions contain chlorine ion at a concentration of preferably $3.5\times10^{-2}$ to $1.5\times10^{-1}$ mol/l, particularly preferably $4\times10^{-2}$ to $1\times10^{-1}$ mol/l. When the concentration of chlorine ion is higher than $1.5\times10^{-1}$ mol/l, there is a disadvantage that development is retarded, and rapid processing and high maximum density can not be achieved. When the concentration is lower than $3.5\times10^{-2}$ mol/l, fogging can not be sufficiently prevented.

In the practice of the present invention, it is preferred that the color developing solutions contain bromine ion at a concentration of preferably $3.0\times10^{-5}$ to $1.0\times10^{-3}$ mol/l, more preferably $5.0\times10^{-5}$ to $5\times10^{-4}$ mol/l.

When the concentration of bromine ion is higher than $1\times10^{-3}$ mol/l, development is retarded and maximum density and sensitivity are lowered. When the concentration is lower than $3.0\times10^{-5}$ mol/l, fogging can not be sufficiently prevented.

Chlorine ion and bromine ion may be added directly to the developing solutions, or may be dissolved out from the photographic materials into the developing solutions during development.

When chlorine ion is added directly to the color developing solutions, examples of chlorine ion supply materials include sodium chloride, potassium chloride, ammonium chloride, lithium chloride, nickel chloride, magnesium chloride, manganese chloride, calcium chloride and cadmium chloride. Of these, sodium chloride and potassium chloride are preferred.

If desired, chlorine ion may be supplied from brightening agents contained in the developing solutions.

Examples of bromine ion supply materials include sodium bromide, potassium bromide, ammonium bromide, lithium bromide, calcium bromide, magnesium bromide, manganese bromide, nickel bromide, cadmium bromide, cerium bromide and thallium bromide. Of these, potassium bromide and sodium bromide are preferred.

When these ions are dissolved out from the photographic materials during development chlorine ion and bromine ion may be supplied from the emulsions, or may be externally supplied.

The color developing solutions employed in the practice of the present invention have a pH of preferably 9 to 12, more preferably 9 to 11.0. The color developing solutions may further contain conventional additives.

It is preferred that buffering agents are used to keep the pH in the above range. Examples of the buffering agents include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, aminobutyrates, 2-amino-2-methyl-1,3-propanediol salts, valine salts, proline salts, trishydroxyaminomethane salts, and lysine salts. In particular, carbonates, phosphates, tetraborates and hydroxybenzoates have advantages in that they are excellent in solubility and buffering capacity in the high pH region of 9.0 or higher, they do not have an adverse effect on photographic performance (e.g., fog) when added to the color developing solutions, and they are inexpensive. Accordingly, these compounds are particularly preferred as buffering agents.

More specifically, examples of these buffering agents include sodium carbonate, potassium carbonate, sodium bicarbonate, potassium bicarbonate, sodium tertiary phosphate, potassium tertiary phosphate, disodium hydrogenphosphate, dipotassium hydrogenphosphate, sodium borate, potassium borate, sodium tetraborate (borax), potassium tetraborate, sodium o-hydroxybenzoate (sodium salicylate), potassium p-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, buffering agents which can be used in the present invention are not limited to the above described compounds.

The amounts of these buffering agents to be added to the color developing solutions are preferably not less than 0.1 mol/l, particularly preferably 0.1 to 0.4 mol/l.

The color developing solutions may contain various chelating agents as suspending agents for calcium and magnesium or to improve the stability of the color developing solutions. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

These chelating agents may be used either alone or in combination of two or more.

The chelating agents are used in a sufficient amount to sequester metal ions in the color developing solutions. For example, the chelating agents are used in an amount of 0.1 to 10 g per one liter.

The color developing solutions may optionally contain development accelerators. Examples of the development accelerators include thioether compounds described in JP-B-37-16088, JP-B-37-5987, JP B-38-7826, JP-B-44-12380, JP B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; and 1-phenyl-3-pyrazolidones and imidazoles.

In the present invention, anti-fogging agents may be optionally added. Examples of the anti-fogging agents include alkali metal halides such as sodium chloride, potassium bromide and potassium iodide and organic anti-fogging agents. Typical examples of the organic anti-fogging agents include nitrogen-containing heterocyclic compounds such as benztriazole, 6-nitrobenzimidazole, 5-nitroisoindazole, 5-methylbenztriazole, 5-nitrobenztriazole, 5-chlorobenztriazole, 2-thiazolylbenzimidazole, 2-thiazolylmethylbenzimidazole, indazole, hydroxyazaindolizine and adenine.

It is preferred that the color developing solutions applicable to the present invention contain brightening agents. Preferred examples of the brightening agents include 4,4'-diamino-2,2'-disulfostilbene compounds. The brightening agents are used in an amount of 0 to 5 g/l, preferably 0.1 to 4 g/l.

If desired, various surfactants such as alkylsulfonic acids, arylsulfonic acids, aliphatic carboxylic acids and aromatic carboxylic acids may be added.

The processing temperature of the color developing solution employed in the practice of the present invention is 20° to 50° C., preferably 30° to 40° C. Processing time for the color developing solution is from 20 seconds to 5 minutes, preferably from 30 seconds to 2 minutes. A low replenishment rate for the color developing solution is desirable. The replenishment rate is generally 20 to 600 ml, preferably 50 to 300 ml, more preferably 60 to 200 ml, most preferably 60 to 150 ml per $m^2$ of the photographic material.

The desilvering stage of the present invention is described below.

Generally, the desilvering stage may comprise a bleaching stage-fixing stage; or a fixing stage-bleach-fixing stage; or a bleaching stage-bleach-fixing stage; or a bleach-fixing stage.

Bleaching solutions, bleach-fixing solutions and fixing solutions which can be used in the present invention are illustrated below.

Any bleaching agent can be used as a bleaching agent in the bleaching solutions and bleach-fixing solutions of the present invention. The bleaching agents which can be preferably used include organic complex salts of iron(III), particularly iron(III) salts of organic acids such as aminopolycarboxylic acids (e.g., ethylenediaminetetraacetic acid and diethylenetriaminepentaacetic acid), aminopolyphosphonic acids, phosphonocarboxylic acids, organic phosphonic acids, citric acid, tartaric acid and malic acid; persulfates; and hydrogen peroxide.

Of these, organic complex salts of iron(III) are particularly preferred for rapid processing and preventing environmental pollution. Examples of aminopolycarboxylic acids, aminopolyphosphonic acids, organic phosphonic acids and salts thereof which are useful for the formation of the organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraaceitc acid, methyliminodiacetic acid, iminodiacetic acid and glycol ether diaminetetraacetic acid. These compounds may be in the form of any of sodium, potassium, lithium and ammonium salts. Of these compounds, iron(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred for high bleaching power.

The ferric ion complex salts may be used in the form of a complex salt, or may be formed in the solution by using a ferric salt such as ferric sulfate, ferric chloride, ferric nitrate, ammonium ferric sulfate or ferric phosphate in combination with a chelating agent such as an aminopolycarboxylic acid, an aminopolyphosphonic acid or a phosphonocarboxylic acid. The chelating agent may be used in an amount which is larger than that required for the formation of the ferric ion complex salt. Of the iron complexes, the complexes of iron with the aminopolycarboxylic acids are preferred. The complexes are used in an amount of 0.01 to 1.0 mol/l, preferably 0.05 to 0.50 mol/l.

Further, the bleaching solution or the bleach-fixing solutions employed in the practice of the present invention may contain rehalogenating agents such as bromides (e.g., potassium bromide, sodium bromide, ammonium bromide), chlorides (e.g., potassium chloride, sodium chloride, ammonium chloride) and iodides (e.g., ammonium iodide). If desired, one or more inorganic or organic acids having pH buffer capacity such as borax, sodium metaborate, acetic acid, sodium acetate, sodium carbonate, potassium carbonate, phosphorous acid, phosphoric acid, sodium phosphate, citric acid, sodium citrate or tartaric acid or a salt thereof such as an alkali metal salt thereof or an ammonium salt thereof or a corrosion inhibitor such as ammonium nitrate or guanidine may be added.

Fixing agents which can be used in the bleach-fixing solutions or the fixing solutions include conventional fixing agents, namely, thiosulfates such as sodium thiosulfate and ammonium thiosulfate; thio cyanates such as sodium thiocyanate and ammonium thiocyanate; and water-soluble solvents for silver halide, such as ethylenebisthioglycolic acid, thioether compounds, for example, 3,6-dithia-1,8-octanediol and thioureas. These compounds may be used either alone or in combination of two or more.

Further, specific bleach-fixing solutions comprising a combination of a fixing agent with a large amount of a halide such as potassium iodide as described in JP-A-55-155354 can be used. In the present invention, thiosulfates, particularly ammonium thiosulfate are preferred. The fixing agents are used in an amount of preferably 0.3 to 2 mol/l, more preferably 0.5 to 1.0 mol/l. The pH of the bleach-fixing solution or the fixing solution is preferably 3 to 10, more preferably 5 to 9.

Further, the bleach-fixing solutions may contain brightening agents, anti-foaming agents, surfactants and organic solvents such as polyvinyl pyrrolidone and methanol.

The bleach-fixing solutions and the fixing solutions may contain preservatives. As the preservatives, there are preferred sulfite ion-releasing compounds such as sulfites (e.g., sodium sulfite, potassium sulfite, ammonium sulfite, etc.), bisulfites (e.g., ammonium bisulfite, sodium bisulfite, potassium bisulfite, etc.) and metabisulfites (e.g., potassium metabisulfite, sodium metabisulfite, ammonium metabisulfite, etc.). The solutions contain these compounds in an amount (in terms of sulfite ion) of preferably about 0.02 to 0.05 mol/l, more preferably 0.04 to 0.40 mol/l.

Sulfites are generally used as preservatives, but other compounds such as ascorbic acid, carbonyl bisulfite adducts and carbonyl compounds may be used.

Further, a buffering agent, brightening agent, chelating agent, anti-foaming agent, antiseptic agent, etc. may optionally be added to the bleach-fixing solutions and the fixing solutions.

Generally, washing and/or stabilizing treatments are/is carried out after desilvering such as fixing or bleach-fixing.

The amount of washing water in the washing stage varies widely depending on the characteristics (e.g., depending on materials used such as couplers) of the photographic materials, the use, the temperature of the washing water, the number of washing tanks (the number of stages), the replenishing system (countercurrent, concurrent) and other conditions. The relationship between the amount of water and the number of washing tanks in the multi-stage countercurrent system can be determined by the method described in *Journal of the Society of Motion Picture and Television Engineers*, Vol. 4, p. 248–253 (May 1955). The number of stages in the multi-stage countercurrent system is preferably 2 to 6, particularly preferably 2 to 4.

According to the multi-stage countercurrent system described in the above literature, the amount of washing water can be greatly reduced, for example, to 0.5 to 1 l per $m^2$ of the photographic material.

However, a problem is caused in that the residence time of water in the tanks is prolonged, and as a result, bacteria are grown and the resulting suspended matter is deposited o the photographic material. A method for reducing calcium ion and magnesium ion described in JP-A-62-288838 can be effectively used for the color photographic materials of the present invention to solve the above-mentioned problem. Further, isothiazolone compounds, thiabendazole compounds, described in JP-A-57-8542, chlorine-containing germicides such as sodium chlorinated isocyanurate described in JP-A-61-

120145, benztriazole described in JP-A-61-267761, copper ion and germicides described in *Germicidal Antifungal Chemistry*, written by Hiroshi Horiguchi (1986), published by Sankyo Syuppan, *Sterilization, Disinfection, Antifungal Technique of Microorganisms*, edited by Sanitary Technique Society, Kogyo Gijutsu Kai, (1982) and *Antibacterial and Antifungal Cyclopedia*, edited by Nippon Antibacterial Antifungal Society (1986), can be used.

Further, washing water may contain surfactants as wetting agents and chelating agents such as EDTA as water softeners.

The photographic materials are processed with stabilizing solutions after the washing stage, or may be directly processed with stabilizing solutions without the washing stage. Compounds having a function capable of stabilizing an image are added to the stabilizing solutions. Examples of such compounds include aldehyde compounds such as formalin, buffering agents for adjusting the pH of the layers to a value suitable for stabilizing dye, and ammonium compounds. Further, the aforesaid various germicides and mildew-proofing agents can be added to prevent bacteria from growing in the solution and to impart mildew resistance to the photographic materials after processing.

Furthermore, a surfactant, brightening agent and hardening agent can be added. When stabilization is directly carried out without the washing stage in the processing of the photographic materials of the present invention, all of the conventional methods described in JP-A-57-8543, JP-A-58-14834 and JP-A-60-220345 can be used.

It is also preferable to use chelating agents such as 1-hydroxyethylidene-1,1-diphosphonic acid and ethylenediaminetetramethylenephosphonic acid and magnesium and bismuth compounds are used.

The rinsing solution can be used as a washing solution or a stabilizing solution after desilverization.

The pH of the solution in the washing stage or the stabilizing stage is preferably 4 to 10, more preferably 5 to 8. The temperature varies depending on the use and characteristics of the photographic materials, but is generally 15° to 45° C., preferably 20° to 40° C. The time is not critical, but a shorter time is preferred for shortening the processing time. The time is preferably 15 to 105 seconds, more preferably 30 to 90 seconds. Less replenishment rate is preferred for reducing running cost, reducing amounts of solution discharged, and handling properties.

Specifically, preferred replenishment rate per unit area of the photographic material is 0.5 to 50 times, preferably 3 to 40 times the amount carried over from the prebath, or the replenishment rate is not more than one liter, preferably not more than 500 ml per $m^2$ of the photographic material. Replenishment may be carried out continuously or intermittently.

The solution used in the washing and/or stabilizing stages can be further used for a previous stage. For example, an overflow solution of washing water reduced by the multi-stage countercurrent system is allowed to flow into the bleach-fixing bath which is a prebath, and the bleach-fixing bath is replenished with a concentrated solution to thereby reduce the amount of the waste solution.

The present invention is now illustrated in greater detail by reference to the following examples which, however, are not to be construed as limiting the invention in any way.

EXAMPLE 1

32 g of lime-processed gelatin were dissolved in 1000 ml of distilled water at 40° C., and 3.3 g of sodium chloride were added thereto. The temperature of the mixture was raised to 60° C. To the resulting solution were added 3.2 ml of N,N'-dimethylimidazolidine-2-thione (1% aqueous solution). To the resulting solution, there were added a solution of 32.0 g of silver nitrate dissolved in 200 ml of distilled water and a solution of 15.7 g of potassium bromide and 3.3 g of sodium chloride dissolved in 200 ml of distilled water over a period of 15 minutes while keeping the temperature at 60° C.

Further, a solution of 128.0 g of silver nitrate dissolved in 560 ml of distilled water and a solution of 62.8 g of potassium bromide and 13.2 g of sodium chloride dissolved in 560 ml of distilled water were added thereto over a period of 20 minutes while keeping the temperature at 60° C.

After the completion of the addition of the aqueous silver nitrate solution and the aqueous alkali halide solution, the temperature was lowered to 40° C., and desalting and water washing were carried out. Further, 90.0 g of lime-processed gelatin was added thereto, and pAg was adjusted to 7.2 by using sodium chloride.

Subsequently, 60.0 mg of each of red-sensitive sensitizing dyes shown in Table 1 and 2.0 mg of triethylthiourea were added thereto, and chemical sensitization was conducted at 58° C. The thus-obtained silver chlorobromide emulsions (silver bromide content: 70 mol %) were referred to as emulsions A-1 to A-10.

The emulsions A-1 to A-10 are different from one another only in the red-sensitive sensitizing dyes shown in Table 1 added before chemical sensitization.

Separately, 32 g of lime-processed gelatin were dissolved in 1000 ml of distilled water, and 3.3 g of sodium chloride were added thereto. The temperature of the mixture was raised to 60° C. To the resulting solution were added 3.2 ml of N,N'-dimethylimidazolidine-2-thione (1% aqueous solution). To the resulting solution, there were added a solution of 32.0 g of silver nitrate dissolved in 200 ml of distilled water and a solution of 11.0 g of sodium chloride dissolved in 200 ml of distilled water over a period of 8 minutes while keeping the temperature at 60° C.

Further, a solution of 125.6 g of silver nitrate dissolved in 560 ml of distilled water and a solution of 41.0 g of sodium chloride dissolved in 560 ml of distilled water were added thereto over a period of 20 minutes while keeping the temperature at 60° C. After one minute from the completion of the addition of the aqueous silver nitrate solution and the aqueous alkali halide solution, 60.0 mg each of red-sensitive sensitizing dyes shown in Table 2 were added thereto. After the mixture was kept at 60° C. for 10 minutes the temperature was lowered to 40° C.

Further, a solution of 2.4 g of silver nitrate dissolved in 20 ml of distilled water and a solution of 1.35 g of potassium bromide and 0.17 g of sodium chloride dissolved in 20 ml of distilled water were added thereto over a period of 5 minutes while keeping the temperature at 40° C. Subsequently, desalting and water washing were carried out. Further, 90.0 g of lime-processed gelatin was added thereto, and pAg was adjusted to 7.2 using sodium chloride.

Subsequently, 2.0 mg of triethylthiourea were added thereto, and chemical sensitization was conducted at 58° C. The thus-obtained silver chlorobromide emulsions (silver bromide content: 1.2 mol %) were referred to as emulsions B-1 to B-10.

The emulsions B-1 to B-10 are different from one another only in the red-sensitive sensitizing dyes shown in Table 2 added before chemical sensitization.

The shape, grain size and grain size distribution of grains contained in each of the thus-prepared 20 silver halide emulsions A-1 to B-10 were determined from electron micrographs. All of the silver halide grains contained in the emulsions A-1 to B-10 were cubic grains. The diameter of the grains is defined as a diameter of a circle having an area equal to the projected area of the grain, and the average thereof is referred to as grain size (mean grain size). The grain size distribution is a value obtained by dividing the standard deviation of the grain size by the mean grain size. The halogen compositions of the emulsion grains were determined from silver halide crystals by X-ray diffraction. The results are shown in Table 1 and Table 2.

TABLE 1

| Emulsion | Sensitizing dye compound No. | Shape | Grain size (μm) | Grain size distribution | Analysis of halogen composition of AgClBr emulsion by X-ray diffraction |
|---|---|---|---|---|---|
| A-1 | S-1 | cube | 0.51 | 0.10 | AgCl; 30% uniform |
| A-2 | S-2 | " | " | " | " |
| A-3 | S-3 | " | " | " | " |
| A-4 | S-4 | " | " | " | " |
| A-5 | S-5 | " | " | " | " |
| A-6 | 4 | " | " | " | " |
| A-7 | 2 | " | " | " | " |
| A-8 | 3 | " | " | " | " |
| A-9 | 5 | " | " | " | " |
| A-10 | 16 | " | " | " | " |

TABLE 2

| Emulsion | Sensitizing dye compound No. | Shape | Grain size (μm) | Grain size distribution | Analysis of halogen composition of AgClBr emulsion by X-ray diffraction |
|---|---|---|---|---|---|
| B-1 | S-1 | cube | 0.52 | 0.08 | composed of 100% AgCl phase and localized phases containing 10% to 39% AgBr |
| B-2 | S-2 | " | " | " | composed of 100% AgCl phase and localized phases containing 10% to 39% AgBr |
| B-3 | S-3 | " | " | " | composed of 100% AgCl phase and localized phases containing 10% to 39% AgBr |
| B-4 | S-4 | " | " | " | composed of 100% AgCl phase and localized phases containing 10% to 39% AgBr |
| B-5 | S-5 | " | " | " | composed of 100% AgCl phase and localized phases containing 10% to 39% AgBr |
| B-6 | 4 | " | " | " | composed of 100% AgCl phase and localized phases containing 10% to 39% AgBr |
| B-7 | 2 | " | " | " | composed of 100% AgCl phase and localized phases containing 10% to 39% AgBr |
| B-8 | 3 | " | " | " | composed of 100% AgCl phase and localized phases containing 10% to 39% AgBr |
| B-9 | 5 | " | " | " | composed of 100% AgCl phase and localized phases containing 10% to 39% AgBr |
| B-10 | 16 | " | " | " | composed of 100% AgCl phase and localized phases containing 10% to 39% AgBr |

Comparative dyes

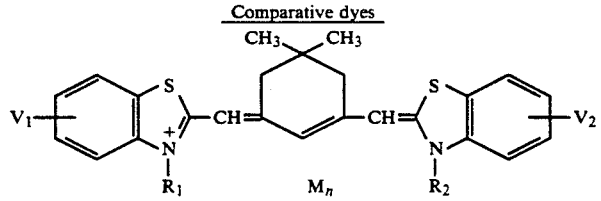

| S-No. | $R_1$ | $R_2$ | $V_1$ | $V_2$ | $M_n$ | n |
|---|---|---|---|---|---|---|
| S-1 | (n)$C_5H_{11}$ | $C_2H_5$ | 6-$CH_3$ | 6-$CH_3$ | $I^-$ | 1 |
| S-3 | $C_2H_5$ | $C_2H_5$ | 6-$CH_3$ | 6-$CH_3$ | $I^-$ | 1 |

-continued

Comparative dyes

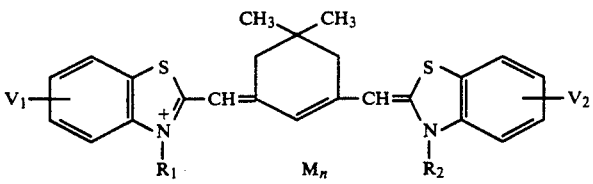

| S-No. | $R_1$ | $R_2$ | $V_1$ | $V_2$ | $M_n$ | n |
|---|---|---|---|---|---|---|
| S-4 | $C_2H_5$ | $C_2H_5$ | H | H | 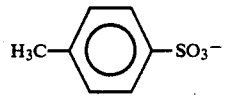 | 1 |
| S-5 | $C_2H_5$ | $C_2H_5$ | 6-$OCH_3$ | 6-$OCH_3$ | $Br^-$ | 1 |
| S-2 | 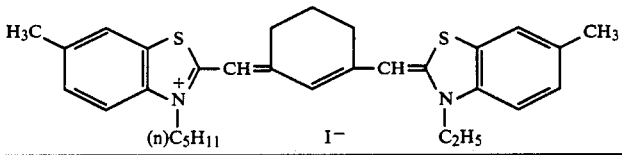 | | | | | |

Both sides of a paper support were laminated with polyethylene, and the support was subjected to a corona discharge treatment. A gelatin undercoat layer containing sodium dodecylbenzenesulfonate was provided thereon, and various photographic constituent layers were coated thereon to prepare a multi-layer color photographic paper having the following layers. Coating solutions were prepared in the following manner.

Preparation of Coating Solution for the First Layer 19.1 g of yellow coupler (ExY), 4.4 g of dye image stabilizer (Cpd-1) and 0.7 g of dye image stabillzer (Cpd-7) were dissolved in 27.2 ml of ethyl acetate, 4.1 g of solvent (solv-3) and 4.1 g of solvent (Solv-7). The resulting solution was emulsified and dispersed in 185 ml of a 10% aqueous gelatin solution containing 8 ml of 10% sodium dodecylbenzenesulfonate to prepare an emulsified dispersion A.

Separately, a silver chlorobromide emulsion containing $2\times10^{-4}$ mol (per mol of silver) of each of the following blue-sensitive sensitizing dyes A and B added thereto was prepared.

The term "the above silver chlorobromide emulsion" is used in the description below of Layer Structure and means that when the silver halide emulsions A-1 to A-10 are used in the fifth layer (red-sensitive layer), the silver chlorobromide emulsion contains 70 mol % of silver bromide and 70 g of Ag/kg, and that when the emulsions B-1 to B-10 are used, the silver chlorobromide emulsion contains 0.8 mol % of silver bromide and 70 g of Ag/kg.

The emulsified dispersion A and the silver chlorobromide emulsion were mixed and dissolved. A coating solution for the first layer was prepared so as to obtain the following composition.

Coating solutions for the second layer through the seventh layer were prepared in the same manner as in the preparation of the coating solution for the first layer. Sodium salt of 1-oxy-3,5-dichloro-S-triazine was used as the hardening agent for gelatin in each layer.

Cpd-10 and Cpd-11 were added to each layer in such an amount as to provide the amounts of 25.0 mg/m$^2$ and 50.0 mg/m$^2$, respectively.

The following spectral sensitizing dyes were used for the silver chlorobromide emulsion of each sensitive emulsion layer.

Sensitizing dye A for blue-sensitive emulsion layer

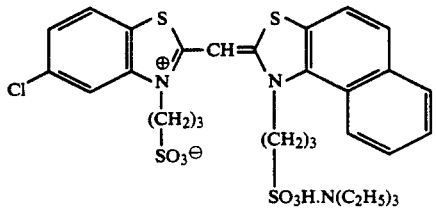

Sensitizing dye B for blue-sensitive emulsion layer

-continued

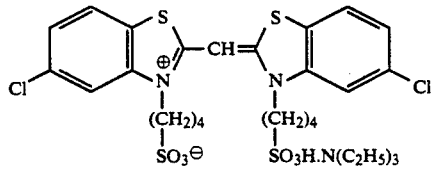

(2.0 × $10^{-4}$ mol of each dye per mol of silver halide being used)

Sensitizing dye C for green-sensitive emulsion layer

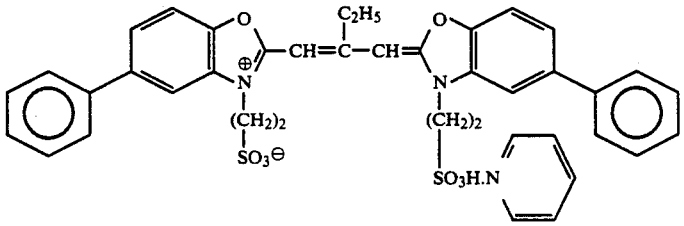

(4.0 × $10^{-4}$ mol per mol of silver halide being used)

Sensitizing dye D for green-sensitive emulsion layer

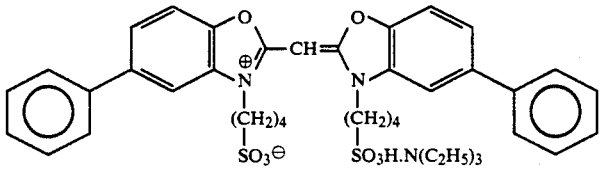

(4.0 × $10^{-4}$ mol per mol of silver halide being used)

$8.5\times10^{-5}$ mol and $7.7\times10^{-4}$ mol of 1-(5-methylureidophenyl)-5-mercaptotetrazole were added to the blue-sensitive emulsion layer and the green-sensitive emulsion layer, respectively, each amount being per mol of silver halide.

Further, $1\times10^{-4}$ mol and $2\times10^{-4}$ mol of 4-hydroxy-6-methyl-1,3,3*a*,7-tetrazaindene were added to the blue-sensitive emulsion layer, respectively, each amount being per mol of silver halide.

The following dyes (parenthesized numerals being coating weights) were added to the emulsion layers to prevent irradiation.

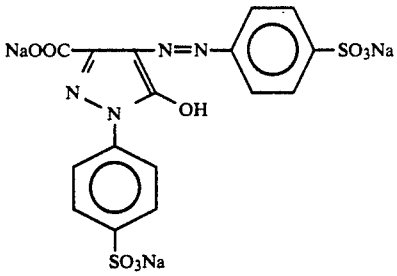

(10 mg/$m^2$)

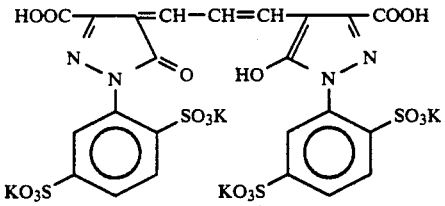

(10 mg/$m^2$)

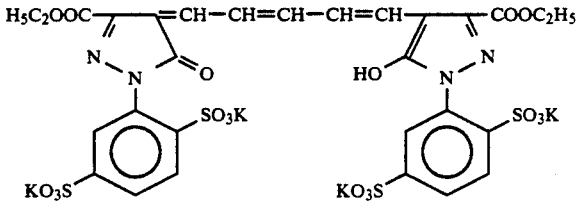

(40 mg/$m^2$)

and

-continued

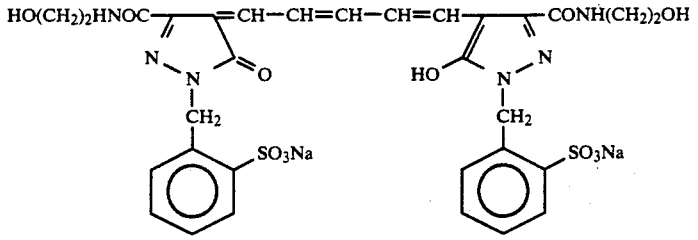

(20 mg/m²)

Layer structure

Each layer had the following composition. Numerals represent coating weights (g/m²). The amounts of the silver halide emulsions are represented by coating weights in terms of silver.

Support

Polyethylene-laminated paper

[Polyethylene on the side of the first layer contained white pigment ($TiO_2$) and bluish dye (ultramarine)]

| | Coating weight |
|---|---|
| First layer (blue-sensitive emulsion layer) | |
| The above silver chlorobromide emulsion | 0.30 |
| Gelatin | 1.86 |
| Yellow coupler (ExY) | 0.82 |
| Dye stabilizer (Cpd-1) | 0.19 |
| Solvent (Solv-3) | 0.18 |
| Solvent (Solv-7) | 0.18 |
| Dye image stabilizer (Cpd-7) | 0.06 |
| Second layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (green-sensitive emulsion layer) | |
| The above silver chlorobromide emulsion | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer (ultraviolet absorbing layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (red-sensitive emulsion layer) | |
| The above silver chlorobromide emulsion | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified copolymer of polyvinyl alcohol (a degree of modification: 17%) | 0.17 |
| Liquid paraffin | 0.03 |

(ExY) Yellow coupler
1:1 Mixture (by mol) of

-continued
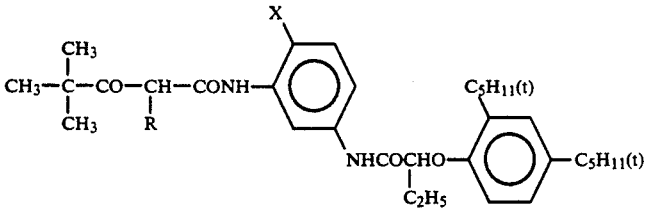
R = 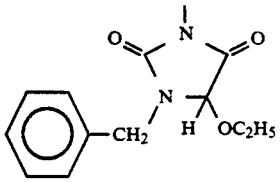 X = Cl and R = 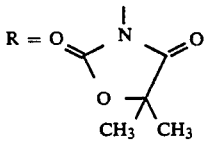 X = $OCH_3$
(ExM) Magenta coupler
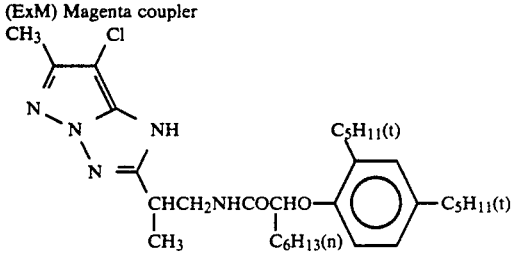
(ExC) Cyan coupler
1:1 Mixture (by mol) of:
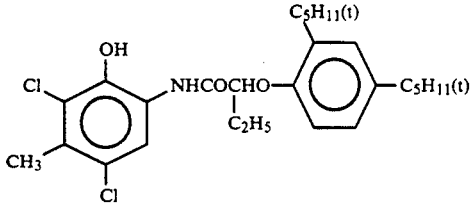 and 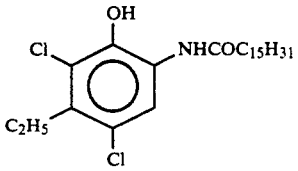
(Cpd-1) Dye image stabilizer
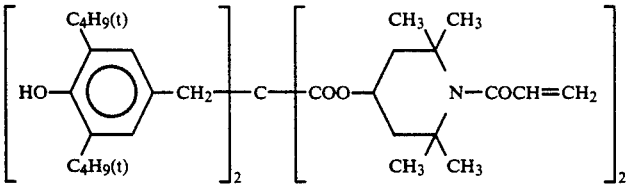
(Cpd-2) Dye image stabilizer
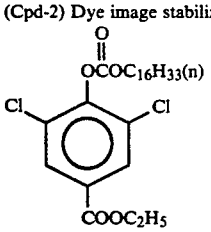
(Cpd-3) Dye image stabilizer
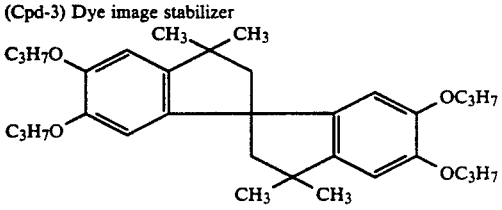
(Cpd-4) Dye image stabilizer -continued
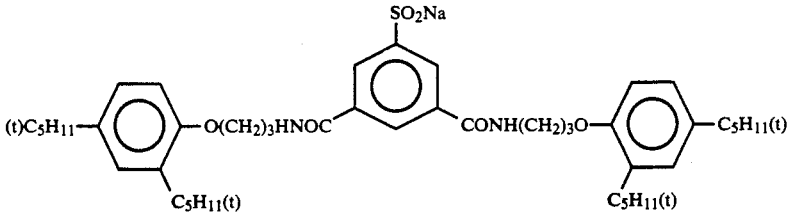
(Cpd-5) Color mixing inhibitor
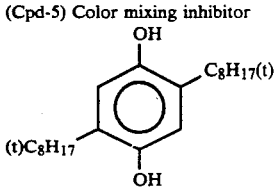
Dye image stabilizer (Cpd-6)
2:4:4 Mixture (by weight) of:
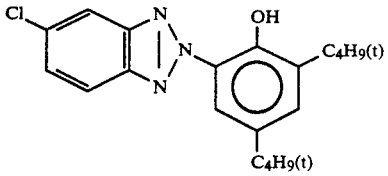
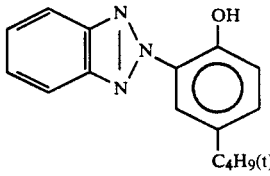
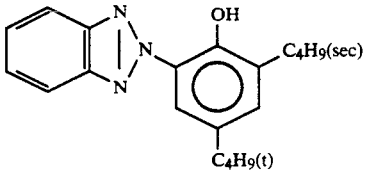
(Cpd-7) Dye stabilizer
$$\left(CH_2-\underset{\underset{CONHC_4H_9(t)}{|}}{CH}\right)_n$$
Average MW 60,000
(Cpd-8) Dye image stabilizer
1:1 mixture (by weight) of:
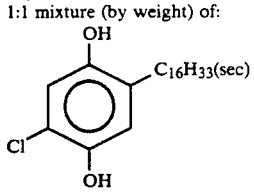
and
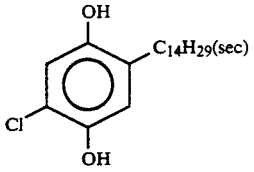
(Cpd-9) Dye stabilizer
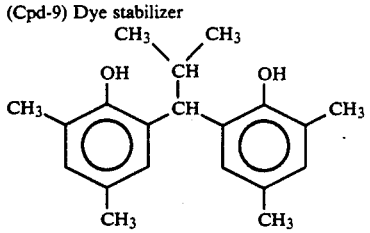
(Cpd-10) Antiseptic agent
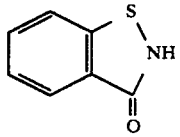
(Cpd-11) Antiseptic agent -continued

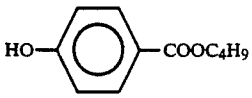

(UV-1) Ultraviolet light absorber
4:2:4 mixture (by weight) of:

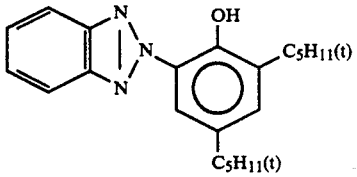

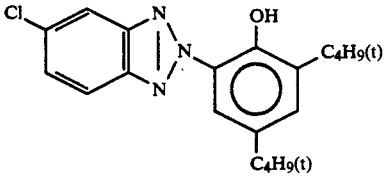

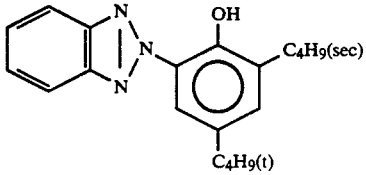

(Solv-1) Solvent

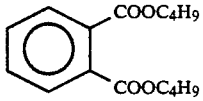

(Solv-2) Solvent
1:1 Mixture (by volume) of:

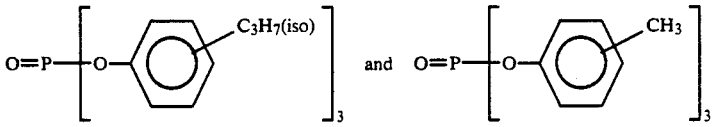

(Solv-3) Solvent
$O{=}P{+}O{-}C_9H_{19}(iso)]_3$ (Solv-4) Solvent

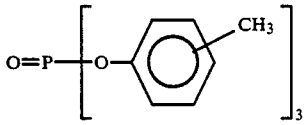

(Solv-5) Solvent
$COOC_8H_{17}$
|
$(CH_2)_8$
|
$COOC_8H_{17}$ (Solv-6) Solvent
80:20 Mixture (by volume) of:

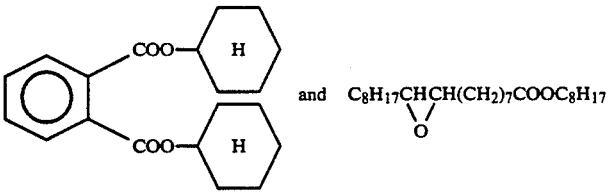

(Solv-7) Solvent
$C_8H_{17}CHCH(CH_2)_7COOC_8H_{17}$
$\backslash\ /$
O

The photographic sensitivity of the thus-obtained multi-layer color photographic paper (photographic materials A-1 to B-10), the range of fluctuation in photographic sensitivity with the passage of time after the preparation of the coating solution, and the rang of fluctuation in photographic sensitivity during storage were evaluated in the following manner.

To evaluate the range of fluctuation in photographic sensitivity with the passage of time after the preparation of the coating solution for the red-sensitive layer, the coating solution was coated after the lapse of 30 minutes at 40° C. and 8 hours at 40° C. from the preparation thereof. Each sample was exposed through an optical wedge and a red filter for 0.5 seconds, and color development was then carried out using the following developing solution in the following development stage.

To evaluate the range of fluctuation in photographic sensitivity during storage, the coated sample was stored at 60° C. and 40% RH for 3 days, and then kept at 15° C. and 55% RH before exposure, and the sample was exposed and processed in the same manner as described above.

The reflection density of the thus-prepared sample processed in the manner described above was measured to obtain a characteristic curve.

The evaluation of photographic characteristics was made with respect to sensitivity and fog. The sensitivity is represented by the relative value of the reciprocal of exposure amount providing a cyan density of 1.0.

The evaluation of the range of fluctuation in photographic sensitivity with the passage of time after preparation of the coating solution was made in such a way that in an exposure amount giving a density of 1.0 to the sample after the lapse of 30 minutes at 40° C., a change ($\Delta D$) in the density of the sample after the lapse of 6 hours at 40° C. (change in coating solution with time) was determined.

The evaluation of the range of fluctuation in photographic sensitivity during storage of the coated sample before exposure was made in such a way that in an exposure amount giving a density of 1.0 to the coated sample immediately after coating a sample with the coating solution left to stand at 40° C. for 30 minutes after the preparation thereof, a change $\Delta D$ in the density of the coated sample with time (change with time during storage) was determined. These results are shown in Table 3 and Table 4.

The sensitivity and fog of fresh are the values of the coated sample immediately after coating a sample with the coating solution left to stand at 40° C. for 30 minutes after the preparation thereof. For convenience, the sensitivity of Sample No. 1 in Table 3 was referred to as 100.

A comparison between the emulsions can be made by comparing Table 3 (low silver chloride) and Table 4 (high silver chloride emulsion). Further, a comparison between the dyes can be made by comparing dyes S-1 and S-2 to dyes 4 and 2, respectively; by comparing dye S-3 to dye 3; by comparing dye S-4 to dye 5; and by comparing dye S-5 to dye 16.

It is clear from these results that when the sensitizing dyes are used in combination with the silver chlorobromide emulsion in the multi-layer color photographic paper, the dyes of the present invention exhibit no superiority in photographic performance to comparative dyes. When the dyes of the present invention are used in combination with the high silver chloride emulsions, higher photographic sensitivity is obtained, and the range of fluctuation in photographic sensitivity with time after the preparation of the coating solution and the range of fluctuation in photographic sensitivity with time during storage are narrow in comparison with the comparative dyes.

The exposed samples were subjected to continuous processing (running test) by using the following processing solutions having the following compositions in the following processing stages and using a paper processor until the volume of replenisher became twice the tank capacity in the color development.

| Processing stage | Temp. | Time | Replenisher* | Tank Capacity |
|---|---|---|---|---|
| Color Development | 35° C. | 45 sec | 161 ml | 17 l |
| Bleaching fixing | 30~35° C. | 45 sec | 215 ml | 17 l |
| Rinse (1) | 30~35° C. | 20 sec | — | 10 l |
| Rinse (2) | 30~35° C. | 20 sec | — | 10 l |
| Rinse (3) | 30~35° C. | 20 sec | 350 ml | 10 l |
| Drying | 70~80° C. | 60 sec | | |

*Replenishment rate being per $m^2$ of photographic material

A three tank countercurrent system of rinse (3)→(1) was used.

Each processing solution had the following composition.

| Color developing solution | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Sodium salt of N,N-di(sulfoethyl)hydroxylamine | 4.0 g | 5.0 g |
| Brightening agent (WHITEX 4B, Sumitomo Chemical Co., Ltd.) | 1.0 g | 2.0 g |
| Water to make | 1000 ml | 1000 ml |
| pH (25° C.) | 10.05 | 10.45 |

| Bleach-fixing solution (Tank solution and replenisher being the same) | |
|---|---|
| Water | 400 ml |
| Ammonium thiosulfate (70%) | 100 ml |
| Sodium sulfite | 17 g |
| Ammonium ethylenediaminetetraacetato ferrate | 55 g |
| Disodium ethylenediaminetetraacetate | 5 g |
| Ammonium bromide | 40 g |
| Water to make | 1,000 ml |
| pH (25° C.) | 6.0 |

Rinsing water (Tank solution and replenisher being the same)

Ion-exchanged water (the concentration of each of calcium ion and magnesium ion being not higher than 3 ppm)

TABLE 3

| Sample No. | Photo-graphic material | Sensitizing dye of red-sensitive layer | Supersen-sitizing dye (II) | Supersen-sitizing dye (III) | Fresh Relative sensitivity | Fresh Fog | Change of coating solution with time ΔD | Change of coating solution with time fog | Change with time during storage ΔD | Change with time during storage fog | Remarks |
|---|---|---|---|---|---|---|---|---|---|---|---|
| 1 | A-1 | S-1 | — | — | 100 | 0.05 | −0.13 | 0.06 | −0.20 | 0.07 | Comparison |
| 2 | " | " | II-1 | — | 120 | 0.07 | −0.12 | 0.07 | −0.18 | 0.07 | " |
| 3 | " | " | " | III-9 | 140 | 0.06 | −0.11 | 0.06 | −0.17 | 0.07 | " |
| 4 | " | " | II-1 | III-9 | 210 | 0.05 | −0.10 | 0.05 | −0.15 | 0.06 | " |
| 5 | A-2 | S-2 | " | " | 205 | 0.04 | −0.15 | 0.05 | −0.17 | 0.04 | " |
| 6 | A-3 | S-3 | " | " | 205 | 0.05 | −0.20 | 0.06 | −0.31 | 0.06 | " |
| 7 | A-4 | S-4 | " | " | 151 | 0.06 | −0.24 | 0.06 | −0.15 | 0.07 | " |
| 8 | A-5 | S-5 | II-13 | III-5 | 235 | 0.07 | −0.21 | 0.07 | −0.30 | 0.08 | " |
| 9 | A-6 | 4 | — | — | 105 | 0.06 | −0.10 | 0.06 | −0.19 | 0.07 | " |
| 10 | " | " | II-1 | — | 122 | 0.07 | −0.09 | 0.08 | −0.18 | 0.07 | " |
| 11 | " | " | — | III-9 | 143 | 0.06 | −0.10 | 0.06 | −0.17 | 0.06 | " |
| 12 | " | " | II-1 | III-9 | 213 | 0.05 | −0.09 | 0.05 | −0.16 | 0.05 | " |
| 13 | A-7 | 2 | " | " | 210 | 0.04 | −0.14 | 0.05 | −0.16 | 0.05 | " |
| 14 | A-8 | 3 | " | " | 206 | 0.04 | −0.19 | 0.04 | −0.30 | 0.05 | " |
| 15 | A-9 | 5 | " | " | 153 | 0.05 | −0.24 | 0.05 | −0.34 | 0.06 | " |
| 16 | A-10 | 16 | II-13 | III-5 | 236 | 0.06 | −0.22 | 0.06 | −0.30 | 0.06 | " |

(II): amount added being $2.6 \times 10^{-3}$ mol per mol of silver halide
(III): amount added being $2.5 \times 10^{-4}$ mol per mol of silver halide

TABLE 4

| Sample No. | Photo-graphic material | Sensitizing dye of red-sensitive layer | Supersen-sitizing dye (II) | Supersen-sitizing dye (III) | Fresh Relative sensitivity | Fresh Fog | Change of coating solution with time ΔD | Change of coating solution with time fog | Change with time during storage ΔD | Change with time during storage fog | Remarks |
|---|---|---|---|---|---|---|---|---|---|---|---|
| 17 | B-1 | S-1 | — | — | 85 | 0.05 | −0.20 | 0.05 | −0.22 | 0.06 | Comparison |
| 18 | " | " | II-1 | — | 90 | 0.06 | −0.15 | 0.06 | −0.20 | 0.07 | " |
| 19 | " | " | " | III-9 | 110 | 0.05 | −0.15 | 0.06 | −0.19 | 0.06 | " |
| 20 | " | " | II-1 | III-9 | 200 | 0.05 | −0.14 | 0.06 | −0.16 | 0.06 | " |
| 21 | B-2 | S-2 | " | " | 190 | 0.06 | −0.18 | 0.06 | −0.19 | 0.07 | " |
| 22 | B-3 | S-3 | " | " | 200 | 0.07 | −0.25 | 0.07 | −0.35 | 0.07 | " |
| 23 | B-4 | S-4 | " | " | 141 | 0.05 | −0.27 | 0.05 | −0.37 | 0.06 | " |
| 24 | B-5 | S-5 | II-13 | III-5 | 210 | 0.04 | −0.23 | 0.04 | −0.32 | 0.06 | " |
| 25 | B-6 | 4 | — | — | 110 | 0.05 | −0.09 | 0.05 | −0.17 | 0.05 | Invention |
| 26 | " | " | II-1 | — | 123 | 0.06 | −0.09 | 0.06 | −0.15 | 0.06 | " |
| 27 | " | " | — | III-9 | 150 | 0.05 | −0.09 | 0.05 | −0.13 | 0.04 | " |
| 28 | " | " | II-1 | III-9 | 230 | 0.04 | −0.08 | 0.04 | −0.14 | 0.04 | " |
| 29 | B-7 | 2 | " | " | 230 | 0.04 | −0.12 | 0.03 | −0.08 | 0.04 | " |
| 30 | B-8 | 3 | " | " | 225 | 0.04 | −0.13 | 0.04 | −0.28 | 0.04 | " |
| 31 | B-9 | 5 | " | " | 170 | 0.05 | −0.20 | 0.04 | −0.25 | 0.05 | " |
| 32 | B-10 | 16 | II-13 | III-5 | 240 | 0.04 | −0.18 | 0.05 | −0.15 | 0.04 | " |

(II): amount added being $2.6 \times 10^{-3}$ mol per mol of silver halide
(III): amount added being $2.5 \times 10^{-4}$ mol per mol of silver halide

EXAMPLE 2

Coated samples were prepared in the same manner as in the preparation of the multi-layer color photographic materials of Example 1, except for the following differences.

1. The following high silver chloride emulsion was used in place of the silver chlorobromide emulsion (a) Emulsion for the first layer (blue-sensitive emulsion layer)

Cubic grains, a 3:7 mixture (by Ag molar ratio) of a larger-size emulsion A having a mean grain size of 0.88 μm and a smaller-size emulsion A having a mean grain size of 0.70 μm. A coefficient of variation in grain size distribution being 0.08 and 0.10, respectively; 0.3 mol % of silver bromide being localized on a part of the surface of the grain in each emulsion. The chemical ripening of the emulsion was conducted by adding a sulfur sensitizing agent and a gold sensitizing agent.

(b) Third layer (green-sensitive emulsion layer)

Cubic grains, a 1:3 mixture (by Ag molar ratio) of a larger-size emulsion B having a mean grain size of 0.55 μm and a smaller-size emulsion B having a mean grain size of 0.39 μm. A coefficient of variation in grain size distribution being 0.10 and 0.08, respectively; 0.8 mol % of AgBr being localized on a part of the surface of the grain in each emulsion.

(c) Fifth layer (red-sensitive emulsion layer)

Cubic grains, a 1:4 mixture (by Ag molar ratio) of a larger-size emulsion C having a mean grain size of 0.58 μm and a smaller-size emulsion C having a mean grain size of 0.45 μm. A coefficient of variation in grain size distribution being 0.09 and 0.11, respectively; 0.6 mol % of AgBr being localized on a part of the surface of the grain in each emulsion.

2. The amounts of the sensitizing dyes added were changed to the following amounts.

(a) Sensitizing dyes A and B for the blue-sensitive emulsion layer $2.0 \times 10^{-4}$ mol of each of the dyes being added to the larger-size emulsion A, and $2.5 \times 10^{-4}$ mol of each of the dyes being added to the smaller-size emulsion A, each amount being per mol of silver halide.

The chemical ripening of this emulsion was conducted by adding a sulfur sensitizing agent each a gold sensitizing agent.

(b) Sensitizing dye C for the green-sensitive emulsion layer $4.0\times10^{-4}$ mol being added to the larger-size emulsion B, and $5.6\times10^{-4}$ mol being added to the smaller-size emulsion B, each amount being per mol of silver halide.

(c) Sensitizing dye D for the green-sensitive emulsion layer $4.0\times10^{-5}$ mol being added to the larger-size emulsion B, and $1.0\times10^{-5}$ mol being added to the smaller-size emulsion B, each amount being per mol of silver halide.

(d) Sensitizing dye for the red-sensitive emulsion layer $0.9\times10^{-4}$ mol being added to the larger-size emulsion C, and $1.1\times10^{-4}$ mol being added to the smaller-size emulsion C, each amount being per mol of silver halide.

These samples were tested in the same manner as in Example 1, and it was found that similar results could be obtained.

EXAMPLE 3

Coated samples were prepared in the same manner as in Example 1, except that 1,2-bis(vinylsulfonyl)ethane was used as the hardening agent in each layer of the multi-layer color photographic material.

These samples were tested in the same manner as in Example 1, and it was found that similar results could be obtained.

EXAMPLE 4

The silver halide emulsion (4-1) of this Example of the present invention was prepared in the following manner.

| | |
|---|---|
| Solution 1 | |
| $H_2O$ | 1000 ml |
| NaCl | 5.5 g |
| Gelatin | 32 g |
| Solution 2 | |
| Sulfuric acid (1N) | 24 ml |
| Solution 3 | |
| The following solvent (1%) for silver halide | 3 ml |

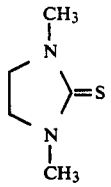

| | |
|---|---|
| Solution 4 | |
| KBr | 3.36 g |
| NaCl | 9.35 g |
| Water to make | 200 ml |
| Solution 5 | |
| $AgNO_3$ | 32 g |
| Water to make | 200 ml |
| Solution 6 | |
| KBr | 13.44 g |
| NaCl | 37.44 g |
| $K_2IrCl_6$ (0.001%) | 4.54 ml |
| Water to make | 600 ml |
| Solution 7 | |
| $AgNO_3$ | 128 g |
| Water to make | 600 ml |

Solution 1 was heated to 56° C., and solution 2 and solution 3 were added thereto. Subsequently, solution 4 and solution 5 were simultaneously added thereto over a period of 10 minutes. After 10 minutes, solution 6 and solution 7 were simultaneously added thereto over a period of 20 minutes. 5 minutes after the addition, the temperature of the mixture was lowered, and a high-molecular coagulant was added thereto to carry out desalting. Water and dispersion gelatin were added, and the pH was adjusted to 6.2 to obtain a monodisperse cubic silver chlorobromide emulsion having a mean grain size of 0.45 μm, a coefficient of variation (a value obtained by dividing standard deviation by mean grain size; s/d) of 0.08 and a silver chloride content of 85 mol %. Further, $1.0\times10^{-4}$ mol (per mol of Ag) of chloroauric acid and sodium thiosulfate were added to the emulsion as chemical sensitizing agents.

Silver halide emulsions (4-2), (4-3) and (4-4) were prepared in the same manner as in the preparation of the emulsion (4-1), the emulsions (4-2), (4-3) and (4-4) being different in silver chloride content from the emulsion (4-1), except that the amounts of KBr and NaCl in solution 4 and solution 6 and the time taken for the addition of solution 4 and solution 5 were varied as shown in Table 4-1.

TABLE 4-1

| | Solution 4 | | Solution 6 | | Time taken for addition of solution 4 and solution 5 |
|---|---|---|---|---|---|
| Emulsion | KBr (g) | NaCl (g) | KBr (g) | NaCl (g) | (min.) |
| (4-1) | 3.36 | 9.35 | 13.44 | 37.44 | 10 |
| (4-2) | 2.24 | 9.90 | 8.96 | 39.65 | 9 |
| (4-3) | 1.12 | 10.45 | 4.48 | 41.85 | 9 |
| (4-4) | 0.22 | 10.89 | 0.90 | 43.61 | 8 |

The mean grain size, coefficient of variation and halogen composition of each of the silver halide emulsions (4-1) to (4-4) are shown in Table 4-2.

TABLE 4-2

| | Mean Grain size | Coefficient of variation | Halogen composition (%) | |
|---|---|---|---|---|
| Emulsion | (μm) | (s/d) | Br | Cl |
| (4-1) | 0.45 | 0.07 | 15 | 85 |
| (4-2) | 0.45 | 0.08 | 10 | 90 |
| (4-3) | 0.45 | 0.08 | 5 | 95 |
| (4-4) | 0.45 | 0.08 | 1 | 99 |

The compounds shown in Table 4-3 below were added to each emulsion at 40° C. After 20 minutes, 0.1 g of sodium dodecylbenzenesulfonate per kg of the emulsion was added thereto. Half of the emulsion was coated on a polyethylene terephthalate film base. During this coating, an aqueous solution mainly composed of gelatin and containing sodium salt of 2,4-dichloro-6-hydroxy-1,3,5-triazine as the hardening agent for gelatin, a surfactant, a thickener, etc. was coated as an upper layer simultaneously with the coating of the emulsion layer to provide a protective layer comprising gelatin (1.0 g/m²) to prepare a first set of samples.

The remaining half of the emulsion was continuously stirred at 40° C. for 7⅜ hours. Subsequently, the hardening agent for gelatin, etc. were added thereto, and the emulsion was coated simultaneously with the coating of an upper layer as the protective layer to prepare a second set of samples.

Of the coated samples prepared above, the samples coated without allowing the emulsions in solution to stand at 40° C. for 8 hours total, were further divided into two portions. One of the portions was stored at 45° C. and 80% RH for 3 days. Thus, three different types of samples were obtained. These three types of samples were exposed through both a sharp-cut filter SC-64 (manufactured by Fuji Photo Film Co., Ltd.), which allows light having a longer wavelength than nearly 620 nm to be transmitted, and a continuous wedge to tungsten lamp (color temperature: 2854° K.).

The exposed samples were processed with the following developing solution having the following composition at 20° C. for 5 minutes, stopped, fixed and washed with water. The density of these samples was measured with a P type densitometer (a product of Fuji Photo Film Co., Ltd.) to obtain the values of fog and sensitivity.

The reference point of the optical density at which sensitivity is determined is a density of Fog+0.2. The sensitivity is represented by the reciprocal of an exposure amount having a density of Fog+0.2. Relative sensitivity shown in Table 4-3 is represented by a relative value when the silver chlorobromide emulsions having the same composition are compared with a reference emulsion having the same composition, with the sensitivity of the reference emulsion being referred to as 100, the reference emulsion containing $2.5\times10^{-5}$ mol of the sensitizing dye S-6 per mol of silver, being coated 20 minutes after the addition of the dye, and being not stored at 40° C. and 80% RH.

| Composition of the developing solution | |
|---|---|
| Metol (i.e., 4-Methylaminophenol sulfate) | 2.5 g |
| α-Ascorbic acid | 10.0 g |
| Potassium bromide | 1.0 g |
| Nabox (manufactured by Fuji Photo Film Co., Ltd.) | 35.0 g |
| Water to make | 1.0 liter (pH 9.8) |

It will be understood from the results of Table 4-3 that even when the sensitizing dyes of formula (I) are applied to the silver chlorobromide emulsion having a silver chloride content of 85 mol % which is outside the scope of the invention, there is no advantage in comparison with similar dyes conventionally known.

The same result is observed when using silver chlorobromide emulsions having a low silver chloride content, cubic silver bromide emulsions, octahedral silver bromide emulsions, octahedral silver iodobromide emulsions having a silver iodide content of 3 mol %, and platy (tabular) silver iodobromide emulsions having an average silver iodide content of 8 mol % (wherein the surface of the grain has a lower silver iodide content).

When the silver chloride content exceeds 90 mol %, comparative dyes which have a structure similar to dyes of formula (I) and are conventionally considered to have good performance have difficulty in obtaining good sensitivity, or comparative dyes providing high sensitivity cause a great lowering in sensitivity when the emulsions in solution are stored over a long period of time or when the coated samples are exposed to high humidity after coating as shown in the Sample Nos. 4-40 to 4-117 of Table 4-3. Such a tendency is remarkable with an increase in the silver chloride content. However, the dyes of the present invention can retain high sensitivity in comparison with comparative dyes when the dyes of the present invention are used in high silver chloride emulsions. The comparative dyes are set forth below.

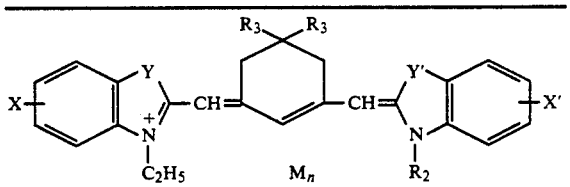

| No. | Y | Y' | $R_3$ | X | X' | $R_2$ | M | n |
|---|---|---|---|---|---|---|---|---|
| S-6 | Se | O | $CH_3$ | 6-$CH_3$ | 4,5-benzo | $C_2H_5$ | $I^-$ | 1 |
| S-7 | S | S | $CH_3$ | 5-$OCH_3$ | H | $(CH_2)_3SO_3^-$ | — | — |
| S-8 | S | S | H | " | " | " | " | " |
| S-9 | S | S | $CH_3$ | 5-$OCH_3$ | 4,5-benzo | " | " | " |
| S-10 | S | S | $CH_3$ | 5-$CH_3$ | 5-$CH_3$ | $C_2H_5$ | $I^-$ | 1 |
| S-11 | S | S | H | " | " | " | " | " |

TABLE 4-3

| Sample No. | Emulsion | Sensitizing dye and amount added ($\times 10^{-5}$ mol/mol of Ag) | | Compound used in combination and amount added ($\times 10^{-4}$ mol/mol of Ag) | | Fog | Relative sensitivity: Sensitivity | Relative sensitivity: Emulsion stored at 40° C. for 8 hr. | Relative sensitivity: Stored at 45° C., 80% RH for 3 days |
|---|---|---|---|---|---|---|---|---|---|
| 4-1 | 4-1 | S-6 | 2.5 | — | | 0.02 | 100 (reference) | 79 | 81 |
| 4-2 | " | | 5.0 | — | | 0.02 | 141 | 120 | 123 |
| 4-3 | " | | 10.0 | — | | 0.02 | 135 | 123 | 123 |
| 4-4 | " | (28) | 2.5 | — | | 0.02 | 110 | 91 | 87 |
| 4-5 | " | | 5.0 | — | | 0.02 | 135 | 115 | 112 |
| 4-6 | " | | 10.0 | — | | 0.02 | 123 | 107 | 110 |
| 4-7 | " | S-7 | 2.5 | — | | 0.02 | 75 | 63 | 62 |
| 4-8 | " | | 5.0 | — | | 0.02 | 95 | 85 | 83 |
| 4-9 | " | | 10.0 | — | | 0.02 | 93 | 89 | 87 |
| 4-10 | " | | 5.0 | III-6 | 5.0 | 0.01 | 195 | 178 | 170 |
| 4-11 | " | S-8 | 2.5 | — | | 0.02 | 59 | 50 | 49 |
| 4-12 | " | | 5.0 | — | | 0.02 | 72 | 69 | 68 |
| 4-13 | " | | 10.0 | — | | 0.02 | 68 | 65 | 69 |
| 4-14 | " | (31) | 2.5 | — | | 0.02 | 65 | 53 | 51 |
| 4-15 | " | | 5.0 | — | | 0.02 | 81 | 72 | 71 |
| 4-16 | " | | 10.0 | — | | 0.02 | 72 | 69 | 68 |
| 4-17 | " | | 5.0 | III-6 | 5.0 | 0.01 | 145 | 135 | 132 |
| 4-18 | 4-1 | S-9 | 2.5 | — | | 0.02 | 138 | 112 | 115 |
| 4-19 | " | | 5.0 | — | | 0.02 | 151 | 135 | 132 |
| 4-20 | " | | 10.0 | — | | 0.02 | 107 | 117 | 120 |
| 4-21 | " | (26) | 2.5 | — | | 0.02 | 135 | 115 | 117 |

TABLE 4-3-continued

| Sample No. | Emulsion | Sensitizing dye and amount added (× $10^{-5}$ mol/mol of Ag) | | Compound used in combination and amount added (× $10^{-4}$ mol/mol of Ag) | | Fog | Relative sensitivity: Sensitivity | Relative sensitivity: Emulsion stored at 40° C. for 8 hr. | Relative sensitivity: Stored at 45° C., 80% RH for 3 days |
|---|---|---|---|---|---|---|---|---|---|
| 4-22 | " | | 5.0 | — | | 0.02 | 126 | 117 | 117 |
| 4-23 | " | | 10.0 | — | | 0.02 | 93 | 100 | 102 |
| 4-24 | " | S-10 | 2.5 | — | | 0.02 | 95 | 74 | 72 |
| 4-25 | " | | 5.0 | — | | 0.02 | 120 | 100 | 98 |
| 4-26 | " | | 10.0 | — | | 0.02 | 117 | 105 | 107 |
| 4-27 | " | | 10.0 | II-1 | 8.0 | 0.02 | 214 | 186 | 191 |
| 4-28 | " | | 10.0 | III-9 | 5.0 | 0.02 | 245 | 204 | 204 |
| 4-29 | " | | 10.0 | II-1 | 8.0 | 0.01 | 269 | 251 | 245 |
| | | | | III-9 | 5.0 | | | | |
| 4-30 | " | S-11 | 2.5 | — | | 0.02 | 81 | 63 | 62 |
| 4-31 | " | | 5.0 | — | | 0.02 | 107 | 89 | 87 |
| 4-32 | " | | 10.0 | — | | 0.02 | 68 | 60 | 60 |
| 4-33 | " | | 10.0 | II-1 | 8.0 | 0.02 | 126 | 112 | 110 |
| 4-34 | 4-1 | (14) | 2.5 | — | | 0.02 | 87 | 71 | 66 |
| 4-35 | " | | 5.0 | — | | 0.02 | 123 | 105 | 105 |
| 4-36 | " | | 10.0 | — | | 0.02 | 110 | 100 | 102 |
| 4-37 | " | | 10.0 | II-1 | 8.0 | 0.02 | 186 | 166 | 162 |
| 4-38 | " | | 10.0 | III-9 | 5.0 | 0.02 | 195 | 170 | 166 |
| 4-39 | " | | 10.0 | II-1 | 5.0 | 0.01 | 219 | 204 | 204 |
| | | | | III-9 | 8.0 | | | | |
| 4-40 | 4-2 | S-6 | 2.5 | — | | 0.02 | 100 (reference) | 69 | 60 |
| 4-41 | " | | 5.0 | — | | 0.02 | 129 | 81 | 81 |
| 4-42 | " | | 10.0 | — | | 0.02 | 132 | 102 | 107 |
| 4-43 | " | (28) | 2.5 | — | | 0.02 | 129 | 105 | 95 |
| 4-44 | " | | 5.0 | — | | 0.02 | 182 | 151 | 148 |
| 4-45 | " | | 10.0 | — | | 0.02 | 173 | 151 | 155 |
| 4-46 | " | S-7 | 2.5 | — | | 0.02 | 95 | 68 | 65 |
| 4-47 | " | | 5.0 | — | | 0.02 | 135 | 102 | 95 |
| 4-48 | " | | 10.0 | — | | 0.02 | 129 | 102 | 100 |
| 4-49 | " | | 5.0 | III-6 | 5.0 | 0.02 | 234 | 186 | 191 |
| 4-50 | 4-2 | S-8 | 2.5 | — | | 0.02 | 72 | 58 | 55 |
| 4-51 | " | | 5.0 | — | | 0.02 | 93 | 76 | 72 |
| 4-52 | " | | 10.0 | — | | 0.02 | 81 | 65 | 59 |
| 4-53 | " | (31) | 2.5 | — | | 0.02 | 79 | 65 | 62 |
| 4-54 | " | | 5.0 | — | | 0.02 | 145 | 129 | 129 |
| 4-55 | " | | 10.0 | — | | 0.02 | 141 | 129 | 132 |
| 4-56 | " | | 5.0 | III-6 | 5.0 | 0.02 | 275 | 257 | 263 |
| 4-57 | " | S-9 | 2.5 | — | | 0.02 | 145 | 98 | 95 |
| 4-58 | " | | 5.0 | — | | 0.02 | 158 | 112 | 107 |
| 4-59 | " | | 10.0 | — | | 0.02 | 117 | 115 | 112 |
| 4-60 | " | (26) | 2.5 | — | | 0.02 | 162 | 135 | 138 |
| 4-61 | " | | 5.0 | — | | 0.02 | 170 | 162 | 158 |
| 4-62 | " | | 10.0 | — | | 0.02 | 115 | 126 | 135 |
| 4-63 | 4-2 | S-10 | 2.5 | — | | 0.02 | 100 | 62 | 59 |
| 4-64 | " | | 5.0 | — | | 0.02 | 132 | 89 | 87 |
| 4-65 | " | | 10.0 | — | | 0.02 | 123 | 89 | 93 |
| 4-66 | " | | 10.0 | II-1 | 8.0 | 0.02 | 224 | 170 | 155 |
| 4-67 | " | | 10.0 | III-9 | 5.0 | 0.02 | 245 | 170 | 174 |
| 4-68 | " | | 10.0 | II-1 | 8.0 | 0.02 | 282 | 174 | 162 |
| | | | | III-9 | 5.0 | | | | |
| 4-69 | " | S-11 | 2.5 | — | | 0.02 | 78 | 52 | 50 |
| 4-70 | " | | 5.0 | — | | 0.03 | 98 | 74 | 68 |
| 4-71 | " | | 10.0 | — | | 0.03 | 65 | 53 | 50 |
| 4-72 | " | (14) | 2.5 | — | | 0.02 | 93 | 72 | 71 |
| 4-73 | " | | 5.0 | — | | 0.02 | 138 | 120 | 117 |
| 4-74 | " | | 10.0 | — | | 0.03 | 117 | 110 | 107 |
| 4-75 | " | | 10.0 | II-1 | 8.0 | 0.02 | 209 | 191 | 191 |
| 4-76 | " | | 10.0 | III-9 | 5.0 | 0.02 | 229 | 200 | 195 |
| 4-77 | " | | 10.0 | II-1 | 8.0 | 0.02 | 251 | 240 | 234 |
| | | | | III-9 | 5.0 | | | | |
| 4-78 | 4-3 | S-6 | 2.5 | — | | 0.03 | 100 (reference) | 66 | 56 |
| 4-79 | " | | 5.0 | — | | 0.03 | 148 | 115 | 91 |
| 4-80 | " | | 10.0 | — | | 0.04 | 170 | 129 | 135 |
| 4-81 | " | (28) | 2.5 | — | | 0.03 | 138 | 105 | 98 |
| 4-82 | " | | 5.0 | — | | 0.03 | 191 | 148 | 145 |
| 4-83 | " | | 10.0 | — | | 0.03 | 162 | 141 | 138 |
| 4-84 | " | S-8 | 2.5 | — | | 0.03 | 117 | 87 | 85 |
| 4-85 | " | | 10.0 | — | | 0.04 | 120 | 93 | 91 |
| 4-86 | " | | 5.0 | III-6 | 5.0 | 0.02 | 229 | 170 | 155 |
| 4-87 | " | (31) | 5.0 | — | | 0.03 | 195 | 178 | 174 |
| 4-88 | " | | 10.0 | — | | 0.04 | 166 | 151 | 158 |
| 4-89 | " | | 5.0 | III-6 | 5.0 | 0.02 | 295 | 275 | 288 |
| 4-90 | " | S-10 | 5.0 | — | | 0.03 | 155 | 102 | 105 |
| 4-91 | " | | 10.0 | — | | 0.04 | 148 | 105 | 112 |
| 4-92 | " | | 10.0 | II-1 | 8.0 | 0.02 | 269 | 195 | 191 |
| 4-93 | 4-3 | (14) | 5.0 | — | | 0.03 | 182 | 158 | 148 |

TABLE 4-3-continued

| Sample No. | Emulsion | Sensitizing dye and amount added (× $10^{-5}$ mol/mol of Ag) | | Compound used in combination and amount added (× $10^{-4}$ mol/mol of Ag) | | Fog | Relative sensitivity: Sensitivity | Relative sensitivity: Emulsion stored at 40° C. for 8 hr. | Relative sensitivity: Stored at 45° C., 80% RH for 3 days |
|---|---|---|---|---|---|---|---|---|---|
| 4-94 | " | | 10.0 | — | | 0.03 | 155 | 145 | 148 |
| 4-95 | " | | 10.0 | II-1 | 8.0 | 0.02 | 347 | 309 | 309 |
| 4-96 | 4-4 | S-6 | 2.5 | — | | 0.03 | 100 (reference) | 65 | 54 |
| 4-97 | " | | 5.0 | — | | 0.04 | 162 | 91 | 98 |
| 4-98 | " | | 10.0 | — | | 0.04 | 155 | 105 | 120 |
| 4-99 | " | | 10.0 | II-1 | 8.0 | 0.03 | 331 | 186 | 155 |
| 4-100 | " | (28) | 5.0 | — | | 0.04 | 182 | 148 | 141 |
| 4-101 | " | | 10.0 | — | | 0.04 | 170 | 148 | 141 |
| 4-102 | " | | 10.0 | II-1 | 8.0 | 0.03 | 363 | 251 | 234 |
| 4-103 | " | S-7 | 5.0 | — | | 0.05 | 195 | 141 | 132 |
| 4-104 | " | | 10.0 | — | | 0.04 | 162 | 126 | 117 |
| 4-105 | " | | 5.0 | III-6 | 5.0 | 0.04 | 302 | 186 | 204 |
| 4-106 | " | (31) | 5.0 | — | | 0.04 | 229 | 204 | 199 |
| 4-107 | " | | 10.0 | — | | 0.04 | 204 | 195 | 191 |
| 4-108 | " | | 5.0 | III-6 | 5.0 | 0.03 | 525 | 490 | 479 |
| 4-109 | 4-4 | S-10 | 5.0 | — | | 0.04 | 191 | 117 | 93 |
| 4-110 | " | | 10.0 | — | | 0.05 | 186 | 100 | 100 |
| 4-111 | " | | 10.0 | II-1 | 8.0 | 0.03 | 407 | 182 | 166 |
| 4-112 | " | S-11 | 5.0 | — | | 0.05 | 102 | 54 | 56 |
| 4-113 | " | | 10.0 | — | | 0.05 | 83 | 47 | 45 |
| 4-114 | " | | 10.0 | II-1 | 8.0 | 0.04 | 209 | 138 | 123 |
| 4-115 | " | (14) | 5.0 | — | | 0.04 | 245 | 214 | 204 |
| 4-116 | " | | 10.0 | — | | 0.04 | 209 | 186 | 191 |
| 4-117 | " | | 10.0 | II-1 | 8.0 | 0.02 | 479 | 437 | 427 |

EXAMPLE 5

1000 ml of water, 20 g of deionized ossein gelatin and 0.4 g of potassium bromide were added to a reactor. The temperature of the mixture was kept at 60° C., and 36 ml of a 0.47N aqueous solution of silver nitrate and 36 ml of a 0.477N aqueous solution of potassium bromide were added thereto with stirring over a period of one minute. Subsequently, 14 ml of a 50% aqueous solution of ammonium nitrate and 6 ml of a 25% aqueous solution of ammonia were added thereto. After 3 minutes, 1 liter of a 1.18N aqueous solution of silver nitrate and a 1.30N aqueous solution of potassium bromide were added thereto over a period of 50 minutes while silver potential in the reactor to a saturated calomel electrode was kept at +50 mV. The resulting silver bromide emulsion was desilverized. Deionized ossein gelatin and water were added to the emulsion, the pH thereof was adjusted to 6.4 at 40° C., and the pAg thereof was adjusted to 8.5. The silver bromide grains in the emulsion were monodisperse cubes having an average side length of 0.77 μm (a coefficient of variation: 10.8%).

Sodium thiosulfate was added to the emulsion. The emulsion was ripened at 50° C. and sulfur sensitization was conducted. The resulting emulsion was referred to as emulsion (A).

Separately, 1000 ml of water, 30 g of deionized ossein gelatin and 2.81 g of sodium chloride were added to a reactor. The temperature of the mixture was kept at 60° C., and 23.5 ml of 1N sulfuric acid were added thereto with stirring. Subsequently, a 0.210N aqueous solution of silver nitrate and a 0.210N aqueous solution of sodium chloride were added at a constant flow rate of 4.38 ml/min over a period of 40 minutes. After 10 minutes from the completion of the addition, a 2.206N aqueous solution of silver nitrate and a 2.206N aqueous solution of sodium chloride were added at a constant flow rate of 5.00 ml/min over a period of 80 minutes. A high-molecular coagulant was added to the resulting silver chloride emulsion, and the emulsion was washed with water and desalted.

Deionized ossein gelatin and water were added thereto, the pH was adjusted to 6.3 at 40° C. and the pAg was adjusted to 7.4. Silver chloride grains in the resulting emulsion were monodisperse cubes having an average side length of 0.73 μm (a coefficient of variation: 6.5%). Triethylthiourea was added to the emulsion, ripening was carried out at 50° C. and sulfur sensitization was carried out. The resulting emulsion was referred to as emulsion (B).

The compounds shown in Table 5 were added to the thus-prepared emulsion (A) or emulsion (B) at 40° C. After 20 minutes, the emulsion was coated on a cellulose triacetate film base. In this coating, the same protective layer as that of Example 4 was coated as the upper layer simultaneously with the coating of the emulsion layer. Each of the thus-prepared samples was divided into two groups. One of the groups was stored at 50° C. and 75% RH for 3 days, and the other was stored at −20° C. in a refrigerator for 3 days. The samples were then exposed and processed in the same manner as in Example 4. The density of each sample was measured by using a P type densitometer (a product of Fuji Photo Film Co., Ltd.) to obtain the values of fog and sensitivity.

The reference point of the optical density at which sensitivity is determined is a density of (Fog+0.2). The sensitivity is represented by the reciprocal of an exposure amount giving a density of (Fog+0.2). The results are shown in Table 5. Relative sensitivity in Table 5 is represented by a relative value when the emulsions having the same composition are compared with a reference emulsion having the same composition, with the sensitivity of the reference emulsion being referred to as 100, the reference emulsion containing $2.4\times10^{-5}$ mol of comparative sensitizing dye S-12 per mol of silver and being stored at −20° C. in a refrigerator after coating.

Comparative dye S-12

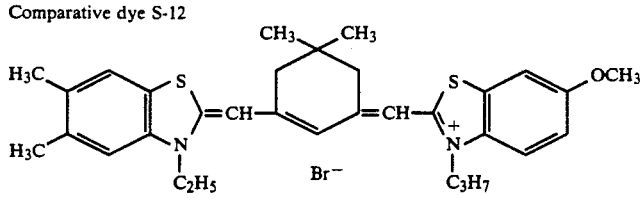

Comparative dye S-13

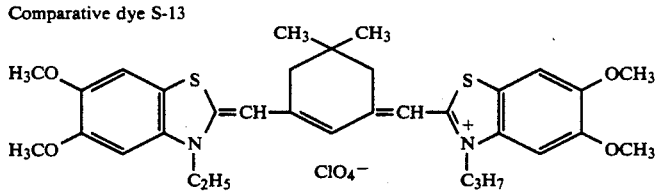

It will be understood from the results of Table 5 that when the sensitizing dyes of the present invention are applied to a silver bromide emulsion, no advantage can be obtained in comparison with conventional compounds as comparative sensitizing dyes. However, when these dyes are applied to a silver chloride emulsion, the comparative dyes cause a great lowering in sensitivity under high temperature and humidity conditions, while the sensitizing dyes of the present invention cause only a slight lowering in sensitivity and the degree of a lowering is nearly equal to that of the lowering caused when applied to a silver bromide emulsion.

TABLE 5

| Sample No. | Emulsion | Sensitizing dye and amount added ($\times 10^{-5}$ mol/mol of Ag) | | Compound used in combination and amount added ($\times 10^{-4}$ mol/mol of Ag) | | Fog | Relative sensitivity: Sample stored at −20° C. | Relative sensitivity: Stored at 50° C., 75% RH |
|---|---|---|---|---|---|---|---|---|
| 5-1 | (A) | S-12 | 2.4 | | | 0.04 | 100 (reference) | 83 |
| 5-2 | " | " | 4.8 | | | 0.05 | 123 | 110 |
| 5-3 | " | " | 9.6 | | | 0.04 | 69 | 71 |
| 5-4 | " | (11) | 2.4 | | | 0.04 | 95 | 85 |
| 5-5 | " | " | 4.8 | | | 0.04 | 120 | 110 |
| 5-6 | " | " | 9.6 | | | 0.04 | 72 | 71 |
| 5-7 | " | S-13 | 2.4 | — | | 0.05 | 105 | 83 |
| 5-8 | " | " | 4.8 | — | | 0.04 | 129 | 110 |
| 5-9 | " | " | 9.6 | — | | 0.04 | 72 | 69 |
| 5-10 | " | " | 9.6 | II-1 | 7.0 | 0.04 | 162 | 148 |
| 5-11 | " | (23) | 2.4 | — | | 0.04 | 107 | 87 |
| 5-12 | " | " | 4.8 | — | | 0.04 | 135 | 117 |
| 5-13 | " | " | 9.6 | — | | 0.04 | 68 | 65 |
| 5-14 | " | " | 9.6 | II-1 | 7.0 | 0.05 | 151 | 141 |
| 5-15 | (B) | S-12 | 2.4 | — | | 0.04 | 100 (reference) | 49 |
| 5-16 | " | " | 4.8 | — | | 0.04 | 151 | 91 |
| 5-17 | " | " | 9.6 | — | | 0.04 | 135 | 93 |
| 5-18 | " | " | 9.6 | KBr | 100 | 0.04 | 166 | 117 |
| 5-19 | " | (11) | 2.4 | — | | 0.04 | 115 | 89 |
| 5-20 | " | " | 4.8 | — | | 0.05 | 162 | 141 |
| 5-21 | " | " | 9.6 | — | | 0.04 | 138 | 132 |
| 5-22 | " | " | 9.6 | KBr | 100 | 0.04 | 195 | 174 |
| 5-23 | " | S-13 | 2.4 | | | 0.04 | 87 | 38 |
| 5-24 | " | " | 4.8 | | | 0.04 | 135 | 69 |
| 5-25 | " | " | 9.6 | | | 0.04 | 123 | 81 |
| 5-26 | " | " | 9.6 | II-1 | 7.0 | 0.05 | 200 | 129 |
| 5-27 | " | (23) | 2.4 | | | 0.04 | 102 | 74 |
| 5-28 | " | " | 4.8 | | | 0.04 | 151 | 129 |
| 5-29 | " | " | 9.6 | | | 0.04 | 123 | 112 |
| 5-30 | " | " | 9.6 | II-1 | 7.0 | 0.04 | 219 | 204 |

It will be understood from the above disclosure that when the spectral sensitivity of photographic materials is increased by using silver halide photographic materials having a high silver chloride (silver chloride content at least 90 mol %) emulsion layer containing a specific sensitizing dye, the preservability of the photographic materials with time under high temperature and humidity conditions is improved (a lowering in sensitivity is small) and the variability of sensitivity from production lot to lot during the preparation of the photographic material can be reduced.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising on a support at least one silver halide emulsion layer having a silver chloride content of not lower than 90 mol %, wherein a silver halide emulsion in at least one of said silver halide emulsion layers having a silver chloride content of not lower than 90 mol % contains at least one compound represented by formula (I):

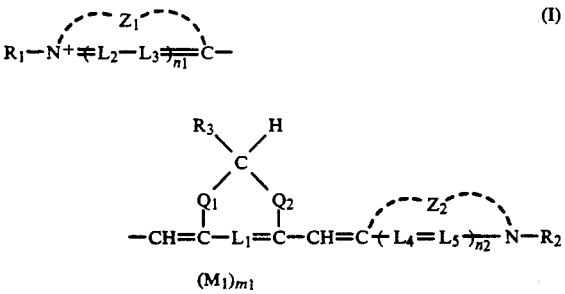

(I)

wherein $Z_1$ and $Z_2$ each represents an atomic group required for forming a nitrogen-containing five-membered or six-membered heterocyclic ring; $Q_1$ and $Q_2$ each represents a methylene group; $R_1$ and $R_2$ each represents an alkyl group; $R_3$ represents an aryl group; $L_1$, $L_2$, $L_3$, $L_4$ and $L_5$ each represents a methine group; $n_1$ and $n_2$ each represents 0 or 1; $M_1$ represents a counter ion for neutralizing electric charge; and $m_1$ represents a number not less than 0 required for neutralizing electric charge in the molecule.

2. A silver halide photographic material as in claim 1, wherein said layer containing at least one compound of formula (I) further contains at least one compound represented by formula (II) and at least one compound represented by formula (III)

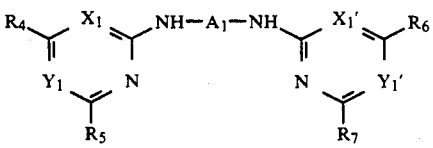

(II)

wherein $A_1$ represents a divalent aromatic group; $R_4$, $R_5$, $R_6$ and $R_7$ each represents a hydrogen atom, a hydroxyl group, an alkoxy group, an aryloxy group, a halogen atom, a heterocyclic ring group, a heterocyclic thio group, an arylthio group, an amino group, an alkylamino group, an arylamino group, an aralkylamino group, an aryl group or a mercapto group provided that at least one of $A_1$, $R_4$, $R_5$, $R_6$ and $R_7$ must be a group having a sulfo group; $X_1$ and $Y_1$ each represents —CH= or —N= and at least one of $X_1$ and $Y_1$ represents —N=; and $X_1'$ and $Y_1'$ have the same meaning as $X_1$ and $Y_1$;

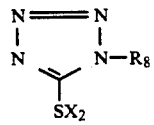

(III)

wherein $R_8$ represents an alkyl group, an alkenyl group or an aryl group; and $X_2$ represents a hydrogen atom, an alkali metal atom, an ammonium group or a precursor group.

3. A silver halide photographic material as in claim 2, wherein the compound represented by formula (II) is present in an amount of 0.01 to 5 g per mol of silver halide and in a ratio by weight to the compound of formula (I) of 1/1 to 100/1.

4. A silver halide photographic material as in claim 2, wherein the compound of formula (III) is present in the same layer that contains a compound of formula (I) and formula (II) and is present in an amount of $1\times10^{-5}$ to $5\times10^{-2}$ mol per mol of silver halide.

5. A silver halide photographic material as in claim 2, wherein the compound of formula (III) is present in an amount of $1\times10^{-4}$ to $1\times10^{-2}$ mol per mol of silver halide.

6. A silver halide photographic material as in claim 1, wherein $Z_1$ and $Z_2$ form a benzthiazole nucleus, a naphthothiazole nucleus, a benzoxazole nucleus or a naphthoxazole nucleus.

7. A silver halide photographic material as in claim 1, wherein $Q_1$ and $Q_2$ each is an unsubstituted methylene group.

8. A silver halide photographic material as in claim 1, wherein $R_1$ and $R_2$ each represents an unsubstituted alkyl group or a sulfoalkyl group.

9. A silver halide photographic material as in claim 1, wherein $L_1$, $L_2$, $L_3$, $L_4$ and $L_5$ each represents an unsubstituted methine group.

10. A silver halide photographic material as in claim 1, wherein $n_1$ and $n_2$ each represents 0.

11. A silver halide photographic material as in claim 1, wherein $M_1$ represents a perchlorate ion, an iodide ion, or a substituted arylsulfonate ion.

12. A silver halide photographic material as in claim 1, wherein the compound of formula (I) is present in an amount of $5\times10^{-7}$ to $5\times10^{-3}$ mol per mol of silver halide.

13. A silver halide photographic material as in claim 1, wherein the compound represented by formula (I) is present in an amount of $1\times10^{-6}$ to $1\times10^{-3}$ mol per mol of silver halide.

14. A silver halide photographic material as in claim 1, wherein the compound represented by formula (I) is present in an amount of $2\times10^{-6}$ to $5\times10^{-4}$ mol per mol of silver halide.

15. A silver halide photographic material as in claim 1, wherein the silver halide emulsion which contains at least one compound represented by formula (I) has a silver chloride content of not lower than 95 mol %.

* * * * *